US005769343A

United States Patent [19]

Tomioka et al.

[11] Patent Number: 5,769,343

[45] Date of Patent: Jun. 23, 1998

[54] APPARATUS FOR SUPPLYING THE BOBBIN THREAD OF THE SEWING MACHINE

[75] Inventors: Hiroyuki Tomioka; Toshinobu Shinozuka, both of Chofu, Japan

[73] Assignee: Juki Corporation, Chofu, Japan

[21] Appl. No.: 653,003

[22] Filed: May 24, 1996

[30] Foreign Application Priority Data

May 25, 1995 [JP] Japan ..... 7-150902
May 25, 1995 [JP] Japan ..... 7-150903
May 25, 1995 [JP] Japan ..... 7-150904

[51] Int. Cl.[6] ..... B65H 54/00; B65H 75/28; B65H 63/00

[52] U.S. Cl. ..... 242/20; 112/273; 112/279; 242/125.3; 242/36

[58] Field of Search ..... 242/20, 18 EW, 242/21, 36, 125.2, 125.3; 112/278, 279, 186, 273, 300

[56] References Cited

U.S. PATENT DOCUMENTS 3,514,615 5/1970 Noiles et al. ..... 242/36 X
3,587,493 6/1971 Ivanko ..... 112/186 X
4,244,313 1/1981 Rovin et al. ..... 242/20 X
4,681,050 7/1987 Kosmas ..... 112/273 X
5,582,355 12/1996 Nakamura .
5,584,257 12/1996 Nakamura et al. ..... 242/20 X
5,606,927 3/1997 Nakamura et al. ..... 242/20 X

FOREIGN PATENT DOCUMENTS 5-192476 8/1993 Japan .
6-304369 11/1994 Japan .
6-304370 11/1994 Japan .
7-80177 3/1995 Japan .
7-246297 9/1995 Japan .

*Primary Examiner*—Michael Mansen
*Attorney, Agent, or Firm*—Morgan & Finnegan LLP

[57] ABSTRACT

An automatic lower-thread winder for use with a sewing machine which automatically rewinds lower thread around a bobbin loaded into the bobbin case, strings the bobbin case with the lower thread, and cuts the lower thread after the bobbin case is strung. The lower-thread winder removes slacks of the lower thread created during the stringing operation. The lower-thread winder is programmed to retry a predetermined number of automatic retrials of the stringing operation, and checks if it has succeeded in the stringing operation. As a consequence, even if it fails in the stringing operation, it repeats the stringing operation automatically or warns the operator. Thus, the lower-thread winder effectively prevents malfunctions caused by defective stringing operations.

10 Claims, 23 Drawing Sheets

FIG.18a
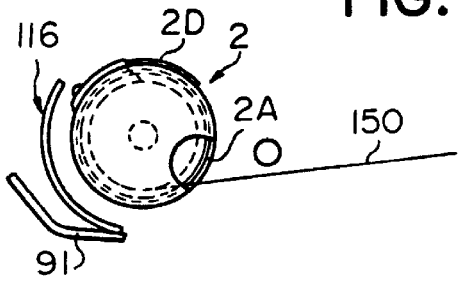
FIG.18b
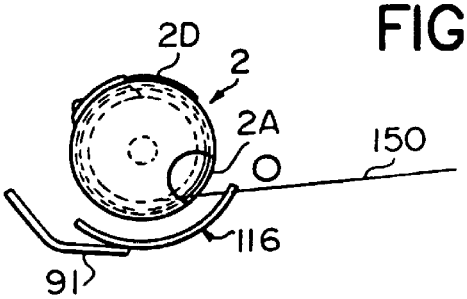
FIG.18c
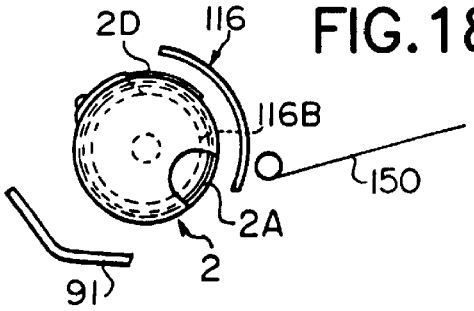
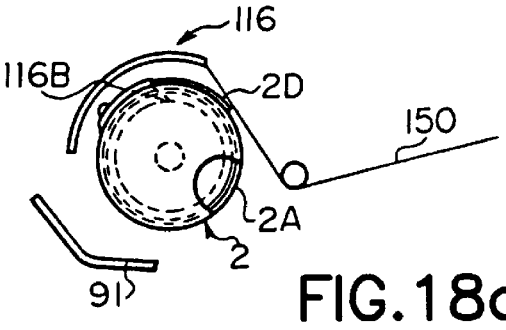
FIG.18d
FIG.18e
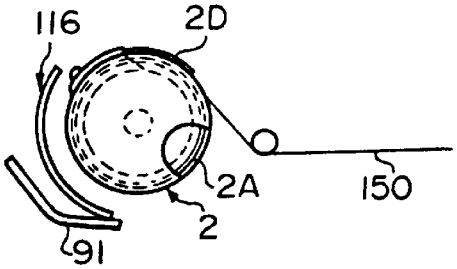
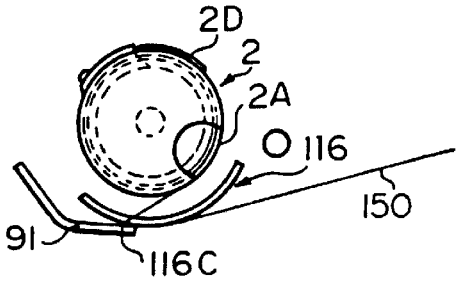
FIG.18f

APPARATUS FOR SUPPLYING THE BOBBIN THREAD OF THE SEWING MACHINE

BACKGROUND OF THE INVENTION

1. Field of the Invention

The present invention relates to an automatic lower-thread winder (or rewinder) for use with a sewing machine which rewinds lower thread around a bobbin in a bobbin case, strings the bobbin case, and cuts the lower thread.

2. Description of the Related Art

Among sewing machines which sew and form a seam with upper and lower thread, industrial high-speed sewing machines particularly consume a large amount of lower thread and require frequent replacements of a lower-thread bobbin. Conventionally, the bobbin replacement has been conducted manually when the lower thread runs out or short: An operator stops the sewing machine, takes off the bobbin case from the shuttle, removes any remaining thread around the bobbin, rewinds the lower thread around it, packs the newly wound bobbin into the bobbin case, threads or strings the bobbin case, cuts the lower thread projecting from the bobbin case, and loads the bobbin case into the shuttle. However, such manual operations are extremely ineffective and causes poor productivity. Accordingly, applicants have attempted to solve this problem by a proposed automatic lower-thread feeder, as disclosed in U.S. patent application Ser. No. 08/279,866 (the "'866 application").

The automatic lower-thread feeder of the '866 application schematically comprises a bobbin case loadable into a shuttle which houses a lower-thread bobbin; a pair of bobbin-case grip units for releasably holding the bobbin case; a bobbin exchanger which includes a rotary arm for rotating the bobbin-case grip units around a certain shaft and moves or slides it along the shaft; a lower-thread winder, arranged apart from the shuttle in the shaft longitudinal direction, which rewinds lower thread around the bobbin, threads or strings the bobbin case, and cuts the lower thread; and a remaining-thread remover which removes remaining thread from the bobbin.

The rotary arm's rotary and/or sliding actions on the shaft enable the bobbin-case grip unit to travel among a shuttle position associated with the shuttle, a remaining-thread removing position associated with the remaining-thread remover, and a lower-thread winding position associated with the lower-thread winder. The proposed automatic lower-thread feeder thus provides high operational efficiency and successfully improves productivity through a series of automatic thread winding, stringing, cutting and removing operations, and a bobbin-case replacing operation.

Nonetheless, the '866 application device is still disadvantageous when the lower-thread winder fails in stringing the bobbin case, because the subsequent automatic procedures follow without correcting the defective strung condition, causing malfunctions.

SUMMARY OF THE INVENTION

Accordingly, it is a general object of the present invention to provide a novel and useful lower-thread winder in which the above disadvantages are eliminated.

Another and more specific object of the present invention is to provide a more reliable lower-thread winder which prevents malfunctions caused by the defective string operation.

Still another object of the present invention is to provide a more automatic lower-thread winder which automatically retrys to string the bobbin case when it fails in a previous stringing attempt.

Keeping in mind the foregoing, a lower-thread winder of the present invention comprises a thread winding unit which winds lower thread supplied from a lower-thread supply source around a bobbin which has been loaded into a bobbin case, a thread guide which includes a stringer for catching the lower thread wound around the bobbin and which strings the bobbin case with the lower thread caught by the stringer by moving the bobbin case and the stringer relative to each other, and a rotary unit, associated with the relative movement of the thread guide, which rotates the bobbin so as to remove slacks of the lower thread between the bobbin and the lower-thread supply source.

Alternatively, a lower-thread winder of the present invention comprises a thread winding unit which winds lower thread supplied from a lower-thread supply source around a bobbin loaded in a bobbin case, a thread guide which strings the bobbin case with the lower thread, grasp means for catching and extending the lower thread by a predetermined distance after the thread guide strings the bobbin case, a detector which checks a condition of the lower thread between the bobbin and the lower-thread supply source when the lower thread is supposed to be caught by the grasp means, and an evaluation unit which evaluates a condition of stringing to the bobbin case based upon a detection result from the detector.

A lower-thread winder of the present invention may include a thread winding unit which winds lower thread around a bobbin by rotating the bobbin which has been loaded into a bobbin case, a thread guide which includes a stringer for catching the lower thread around the bobbin and strings the bobbin case with the lower thread caught by the stringer by moving the bobbin case and the stringer relative to each other, and a clutch which connects the thread winding unit to the bobbin so as to rotate the bobbin while the thread winding unit is winding the lower thread around the bobbin and which disconnects the thread winding unit from the bobbin while the thread guide is stringing the bobbin case.

Moreover, a lower-thread winder of the present invention may include a thread winding unit which winds lower thread around a bobbin loaded into a bobbin case, the bobbin case having an opening through which the lower thread is wound around the bobbin, a guide hole from which the lower thread is to extend and used to form a seam, a slit which connects the opening to the guide hole, stringing means for catching the lower thread around the bobbin and for guiding the lower thread from the opening to the guide hole through the slit, drive means for rotating the bobbin case and the stringing means relative to each other around a bobbin shaft, and transfer means for linearly moving the stringing means and the bobbin case relative to each other along the bobbin shaft while the stringing means and the bobbin case are relatively rotated by the drive means, the drive means and the transfer means assisting the stringing means which has caught the lower thread to guide the lower thread from the opening to the guide hole through the slit.

According to the present invention, the lower-thread winder automatically rewinds the lower thread around the bobbin loaded into the bobbin case, and strings the bobbin case. During the stringing operation, the lower-thread winder moves the bobbin case and the stringing means relative to one another while monitoring the stringing condition and maximizing the operational precision by removing any slack of the lower thread between the bobbin and the lower-thread supply source and blocking any load to be applied to the bobbin. Even when the stringing operation fails, the subsequent automatic retrial or operator's assistance will be readily available.

Other objects and further features of the present invention will become readily apparent upon review of the following description of the preferred embodiments and accompanying drawings.

BRIEF DESCRIPTION OF THE DRAWINGS

FIG. 6(*b*) is a timing chart for explaining operations of the lower-thread winder shown in FIG. 1

FIG. 6(*c*) is a timing chart for explaining operations of the lower-thread winder shown in FIG. 1

FIG. 6(*d*) is a timing chart for explaining operations of the lower-thread winder shown in FIG. 1

FIGS. 18A–18F show side views for explaining arrangements among the bobbin case, the working tool and the fixed cutter during the thread stringing operation and the thread cutting operation by the lower-thread winder of the present invention.

DETAILED DESCRIPTION OF THE PREFERRED EMBODIMENTS

Figure 22:
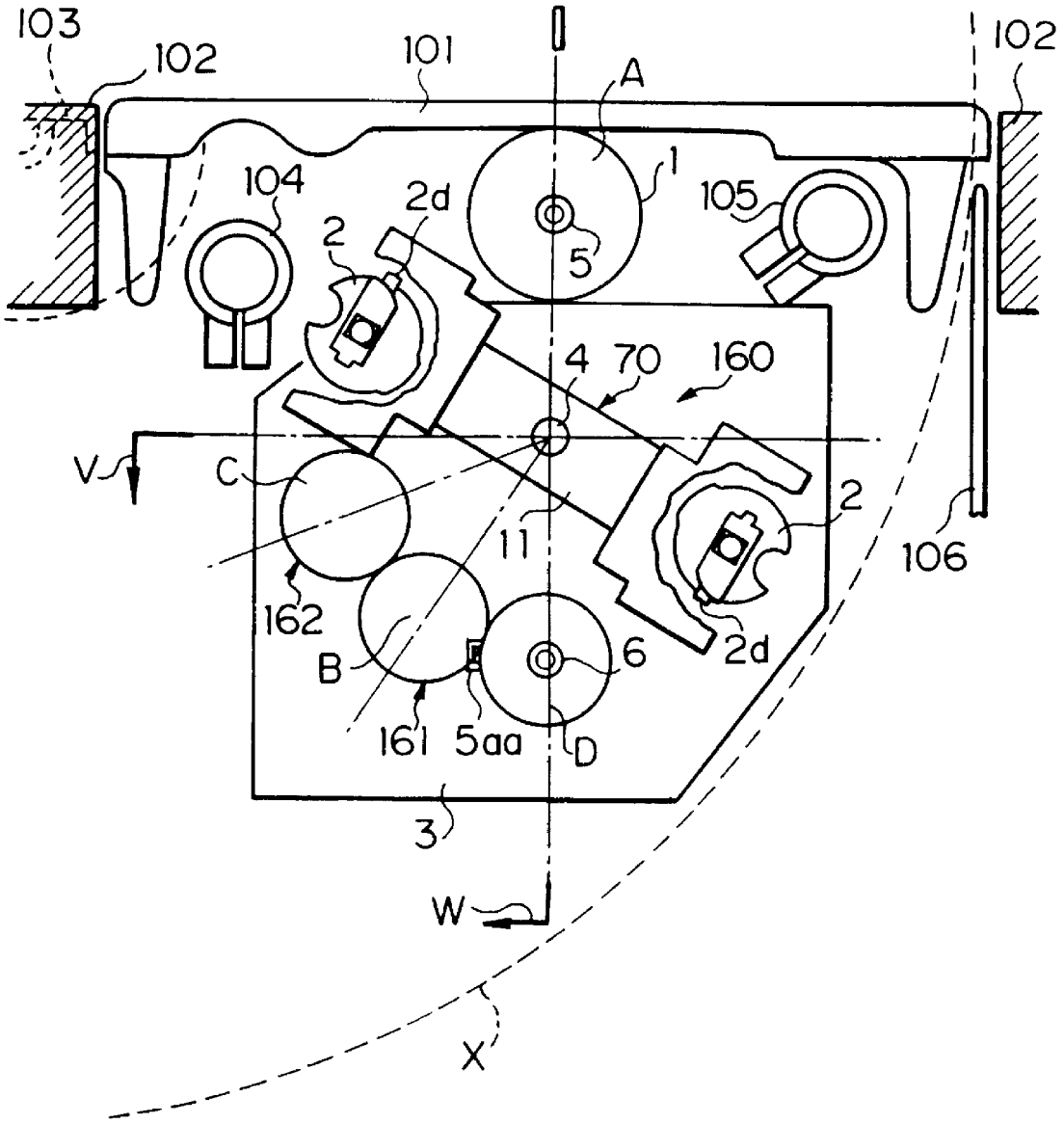
FIG. 22 is a front view of an automatic lower-thread feeder using the lower-thread winder of the present invention.

A description will be given of the embodiment of the present invention with reference to the drawings. An automatic lower-thread feeder of the instant embodiment under sewing-machine bed 101 includes, as shown in FIG. 22, lower-thread winder 162, remaining-thread remover 161, and bobbin exchanger 160 which carries bobbin case 2 among lower-thread winding position C of the lower-thread winder 162, remaining-thread removing position B of the remaining-thread remover 161, shuttle position or loading/ejecting position A, and loading/ejecting position D of dummy shaft 6 as a bobbin-case holder. First, referring now to FIGS. 23 to 27, a description will be given of the bobbin exchanger 160.

In FIGS. 23 to 27, numeral 1 denotes a shuttle into which bobbin case 2 is to be ejectably loaded, numeral la denotes a shuttle shaft, and numeral 3 denotes a base plate which stands firmly upon a main base attached to a sewing-machine body and functions as a supporter below and behind the shuttle 1. The base plate 3 is firmly connected to proximal end 4*a* of carrier shaft 4 as a cantilever. The carrier shaft 4 overhangs parallel to the shuttle shaft 1*a*.

Figure 23:
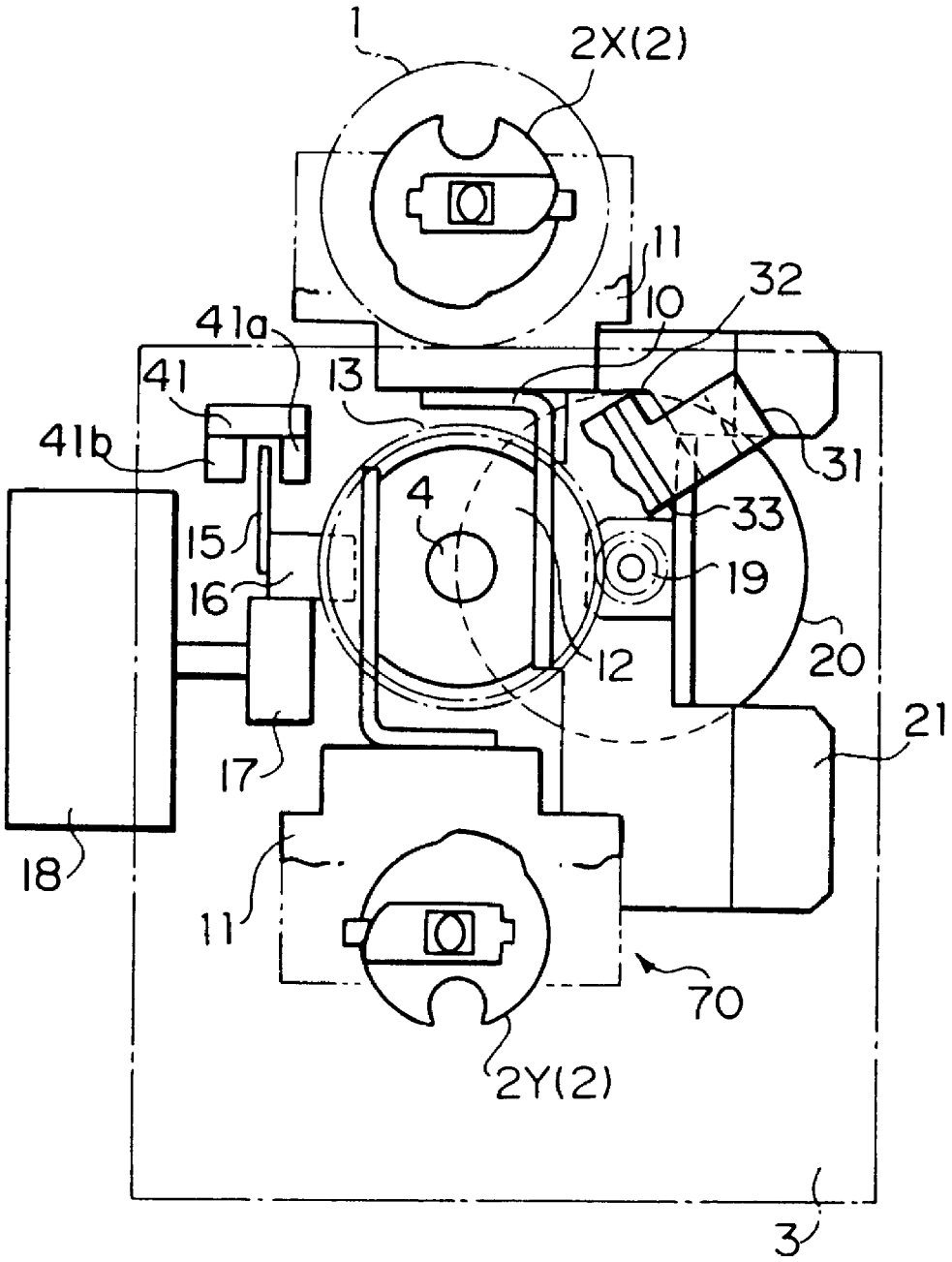
FIG. 23 is a front view of a bobbin exchanger for use with the automatic lower-thread feeder shown in FIG. 22.

Referring to FIG. 23, carrier block 12 is supported rotatably around and slidably along the carrier shaft 4 at distal end 4*b* (opposite to the base plate 3). The carrier block 12 is formed by severing a hollow cylinder by a pair of parallel planes arranged in the axial direction.

A pair of L-shaped carrier plates 10 are secured through their perpendicular portions onto the severed sections of the carrier block 12, and oppose each other through their horizontal portions around the shaft 4 (see FIG. 23). Each carrier plate 10 is coupled to one end of holder 11 which has been bent to the shuttle in the axial direction. The other end of each holder 11 is coupled to a bobbin-case grip unit (not shown) which releasably grasps the bobbin case. The bobbin-case grip unit may use any known device, for instance a pair of electromagnetic absorption heads for use with an automatic lower-thread feeder disclosed in Japanese Laid-Open Patent Applications Nos. 5-192476 and 6-304370 or a lever nail for use with an automatic lower-thread feeder disclosed in Japanese LaidOpen Patent Application No. 6-304369, as long as it is able to releasably load the bobbin case 2 into an opposing member (e.g., shuttle 1) when necessity arises.

Figure 24:
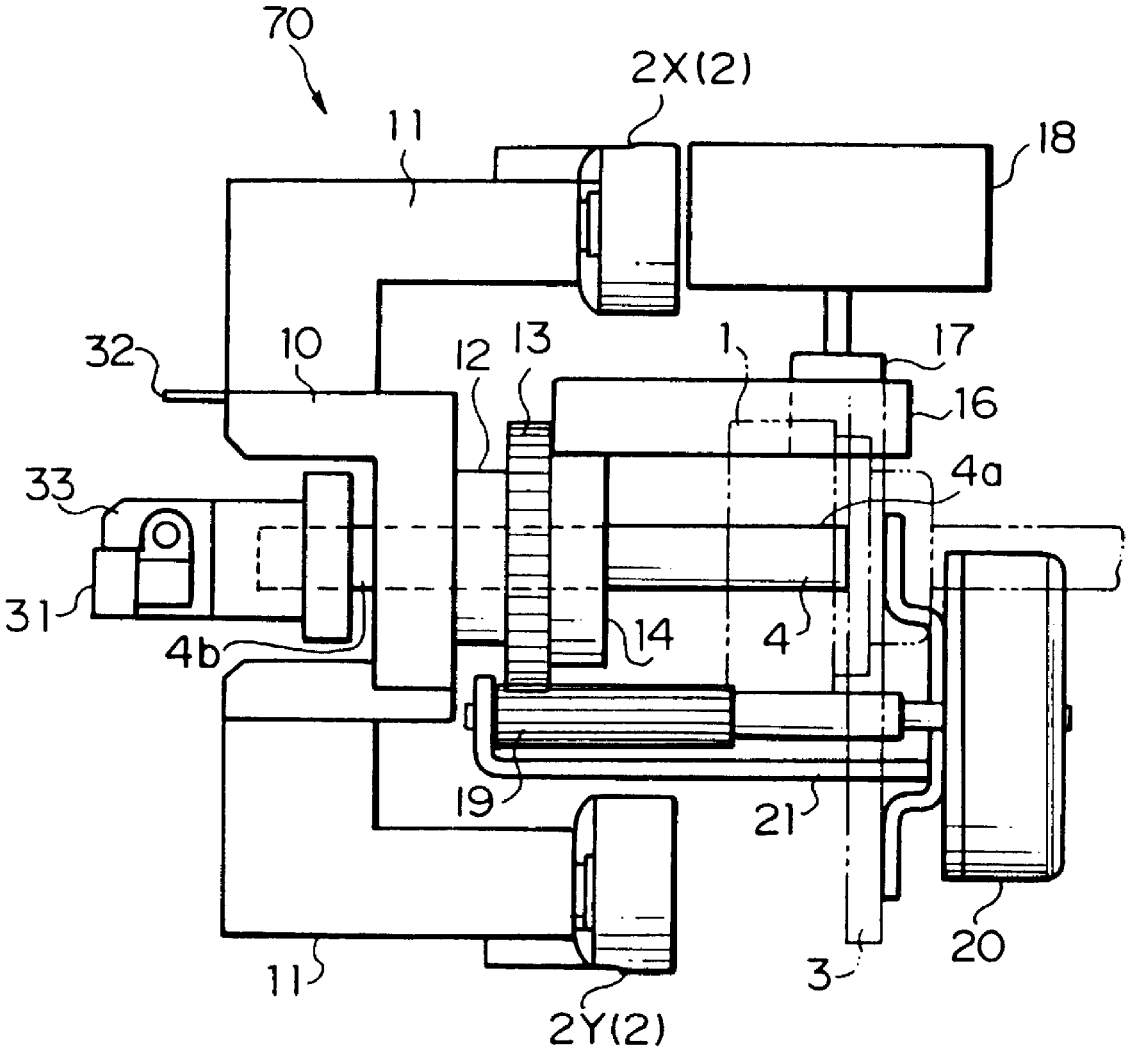
FIG. 24 is a plan view of the bobbin exchanger shown in FIG. 23.

Rotary gear 13 is secured to the circumference of the carrier block 12 and is engaged with drive gear 19 which elongates in the direction of the shuttle shaft 1*a*, as shown in FIG. 24. One end of the drive gear 19 is rotatably supported by an overhang of motor clamp plate 21 extending to the distal end 4*b* of the carrier shaft 4. The other end of the drive gear 19 is directly connected with an output shaft of rotary motor 20. The rotary motor 20 is fixed on the motor clamp plate 21, and the motor clamp plate 21 is mounted on the base plate 3.

Thus, rotary arm 70 is a transfer means which includes the carrier block 12, carrier plates 10, and holders 11, and which rotates, as the rotary motor 20 rotates, via the drive gear 19 and rotary gear 13. The instant embodiment enables the rotary arm 70 to rotate only when it is located at an evacuation position (see FIGS. 24 through 26). In addition, it is important to note that the carrier shaft 4, although a cantilever, has the sufficient support strength as guided by the drive gear 19.

A stop ring (not shown) may be secured to the circumference of the carrier block 12 which is closer to the fixed end 4a of the carrier shaft 4 than the rotary gear 13. Linear collar 14 is rotatably supported between the rotary gear 13 and the stop ring.

Figure 25:
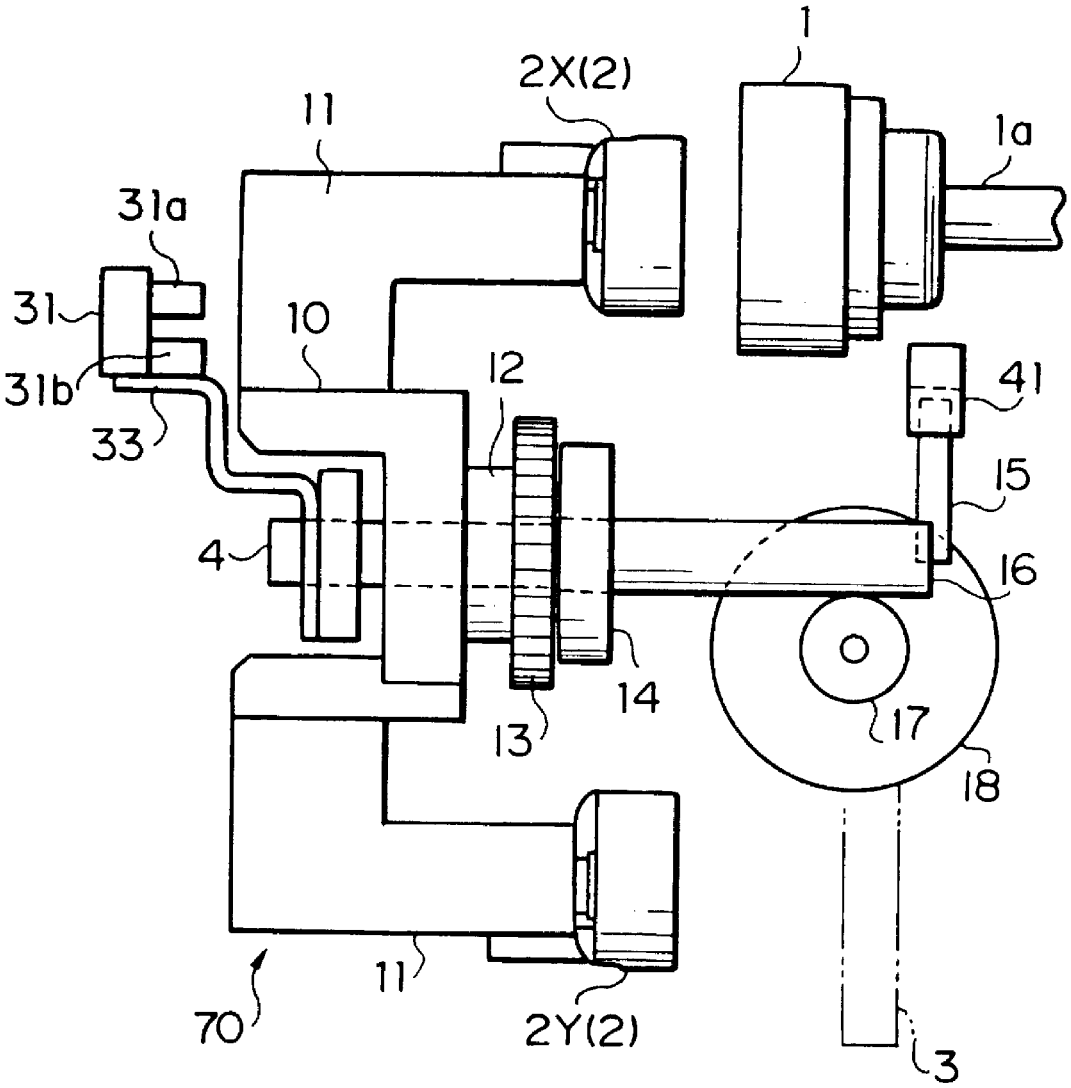
FIG. 25 is a right side view which illustrates a linear action mechanism of the bobbin exchanger shown in FIG. 23.
Figure 26:
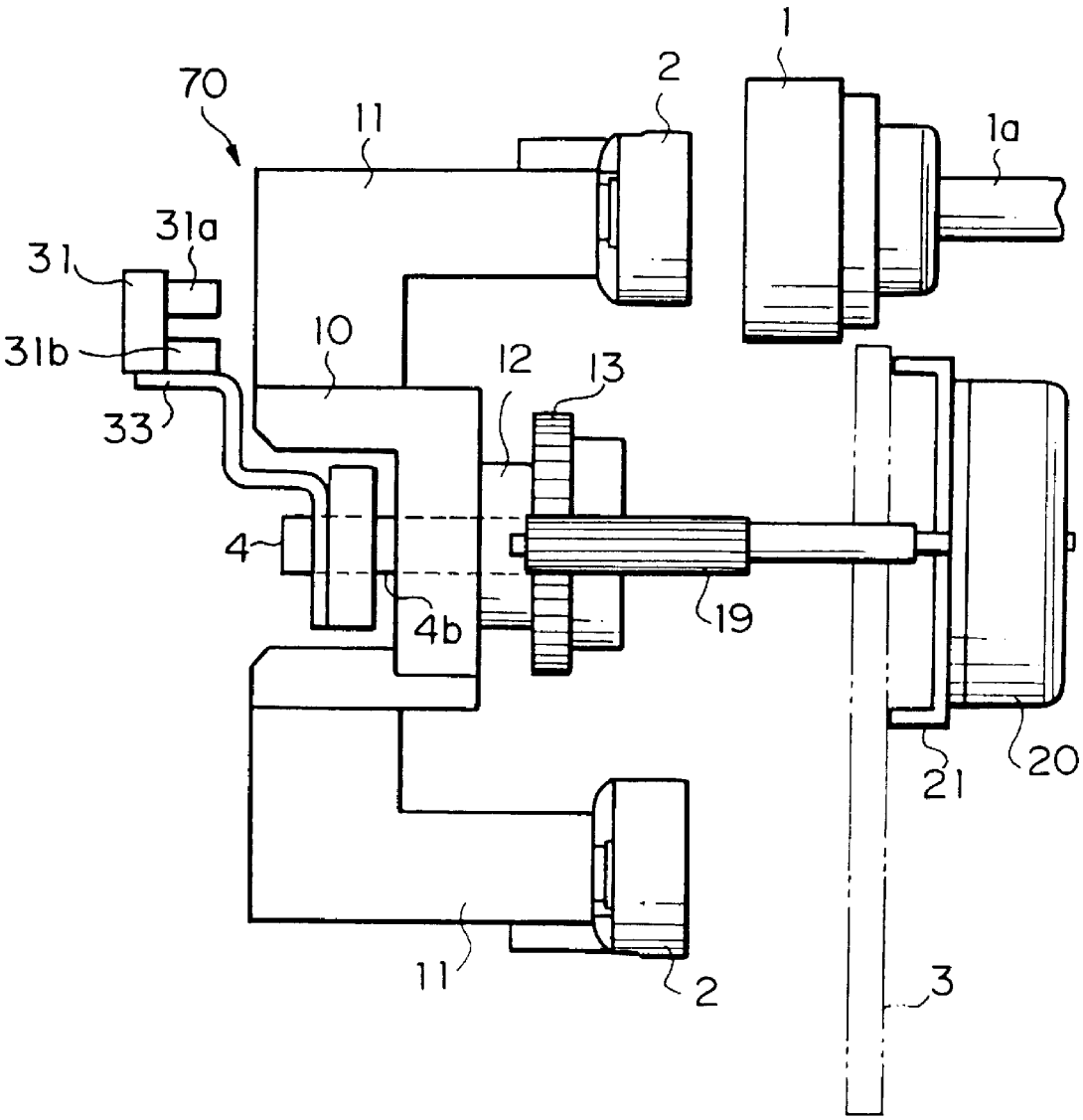
FIG. 26 is a right side view which illustrates a rotary action mechanism of the bobbin exchanger shown in FIG. 23.

The linear collar 14 is coupled, as shown in FIGS. 23–25, to one end of rack 16 which is movably supported parallel to the shuttle shaft la. The other end of the rack 16 is engaged with pinion 17 which is fixed on an output shaft of locomotive motor 18. The locomotive motor 18 is attached to the base plate 3. When the locomotive motor 18 is driven, the rack 16, the linear collar 14, and the rotary arm 70 move along the carrier shaft 4 via the pinion 17. Thus, the rotary arm 70 is rotatable around and slidable along the carrier shaft 4. The rotary arm 70 "advances" when rotary arm 70 moves in a direction from the end 4*b* to the end 4*a*, and "retreats" when it moves in the opposite direction or towards the evacuation position.

Sensor clamp plate 33, attached to the free end 4*b* of the carrier shaft 4, includes rotary sensor 31 which comprises light emitting element 31*a* and light receiving element 31*b*. The rotary arm 70 includes, as shown in FIGS. 23 and 24, sensor plate 32 which is arranged to pass between the light emitting element 31*a* and light receiving element 31*b* when the rotary arm 70 rotates. As shown in FIGS. 23 and 25, linear sensor 41 which has the same structure as the rotary sensor 31 is provided on the base plate 3. Sensor plate 15, fixed onto the rack 16, is arranged to pass between the light emitting element 41*a* and light receiving element 41*a* of the linear sensor 41 when the rotary arm 70 moves linearly.

Figure 27:
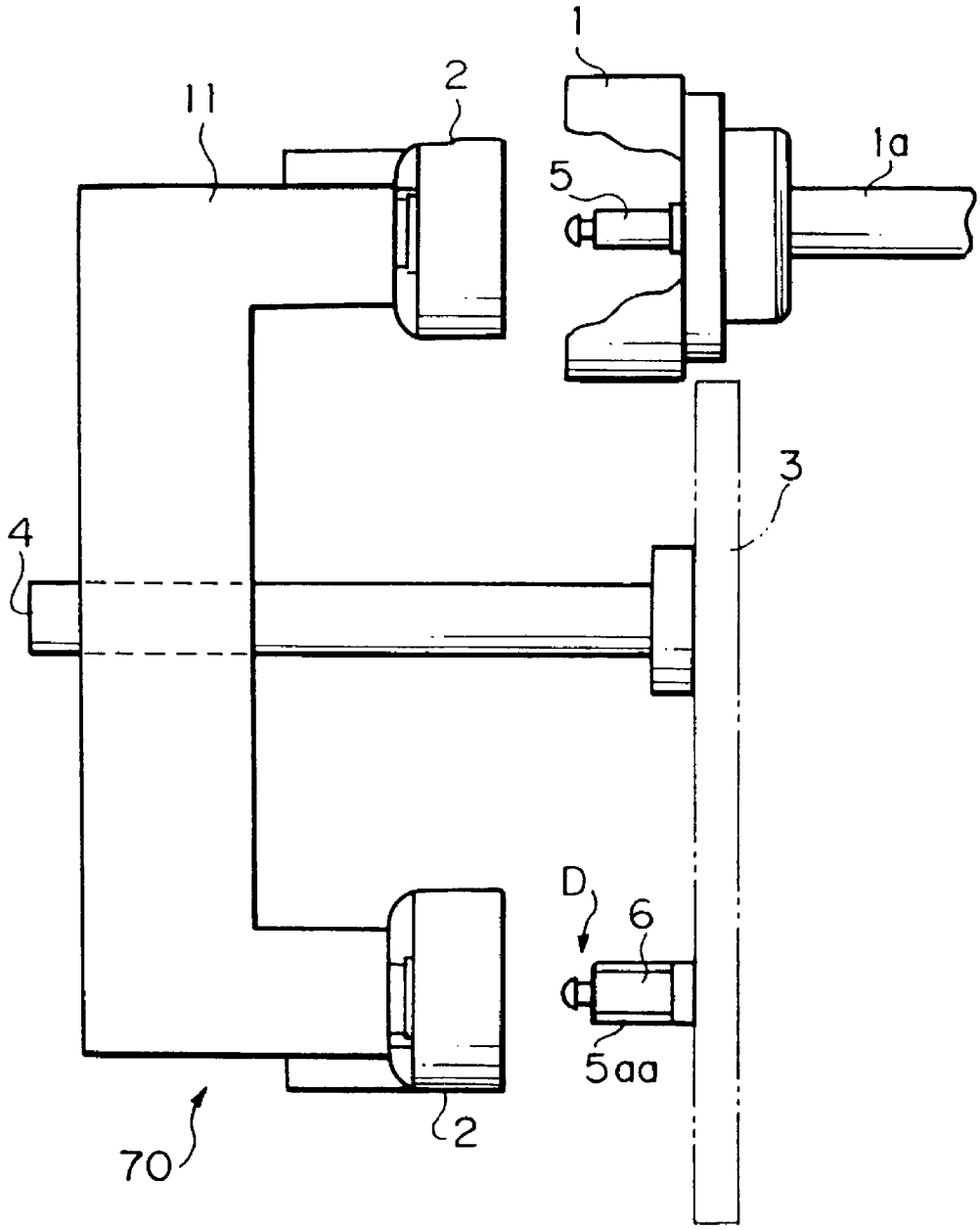
FIG. 27 is a schematic side view for explaining a dummy position and a dummy shaft for use with the bobbin exchanger shown in FIG. 23.

As shown in FIG. 22, the dummy shaft 6 as a bobbin-case holder is secured to the base plate 3 at the position D which is able to be opposite to the rotated bobbin-case grip unit and below the shuttle 1. As shown in FIG. 27, the dummy shaft 6 has substantially the same structure as that of middle shuttle shaft 5, and is able to hold a squeezed bobbin case 2. Since tab 2*d* of the bobbin case 2 is designed to be engageable with rotation stopper 5*aa* near the dummy shaft 6, it will be contemplated that the bobbin case 2 is held in a desired position.

The lower-thread winding position C and the remaining-thread removing position B are located in an overlap of ranges V and W (below and to the left side of the carrier shaft 4 in FIG. 22) and are able to be opposite to the rotated bobbin-case grip unit. The position B is located below the position C. The range W includes fulcrum 103 around which the sewing-machine bed 101 is rotatable. In addition, in a direction perpendicular to the paper of FIG. 22, the position B is located at the evacuation position of the bobbin-case grip unit whereas the position C is located at a position somewhat advanced from the evacuation position of the bobbin-case grip unit in the carrier axial direction, i.e., a position which is advanced towards the paper in FIG. 22. Numeral 102 denotes a sewing-machine table, numeral 106 an oil pan, numerals 104 and 105 lower shafts, and X a locus of a turning sewing-machine head.

The remaining-thread remover 161 is located in a position where it can access the bobbin case 2 at the remaining-thread removing position B. Indeed, the remaining-thread remover 161 is mainly located below the remaining-thread removing position B so as to catch and draw the lower thread hanging from the bobbin case 2 at the position B. The remaining-thread remover 161 releasably holds the edge of the bobbin thread by a grasp unit and automatically reels up the thread held by the grasp unit by, for example, a driving motor. However, any device, such as disclosed in U.S. patent application Ser. No. 08/388,034 and Japanese Laid-Open Patent Application No. 7-80177, is applicable to the remaining-thread remover 161 as long as it removes thread from the bobbin by drawing bobbin thread projecting or hanging from the bobbin case, with the bobbin rotating, while the bobbin case 2 is fixed.

The lower-thread winder 162 is located in position where it can access the bobbin case 2 at the lower-thread winding position C. A conventional lower-thread winder is disclosed in the '866 application which is able to automatically rewind lower thread around the bobbin by a driving motor, then string the bobbin case and cut the extra thread. A description will now be given of the lower-thread winder 162 according to the present invention with reference to FIGS. 1 through 5.

The lower-thread winder 162 includes bobbin drive mechanism E which rotates the bobbin 7; drawing mechanism F which draws out lower thread 150 from spool 200 as a lower-thread supply source (see FIG. 4); and air guide unit G which guides the lower thread 150 drawn from the drawing mechanism F to opening 2A of the bobbin case 2.

Figure 1:
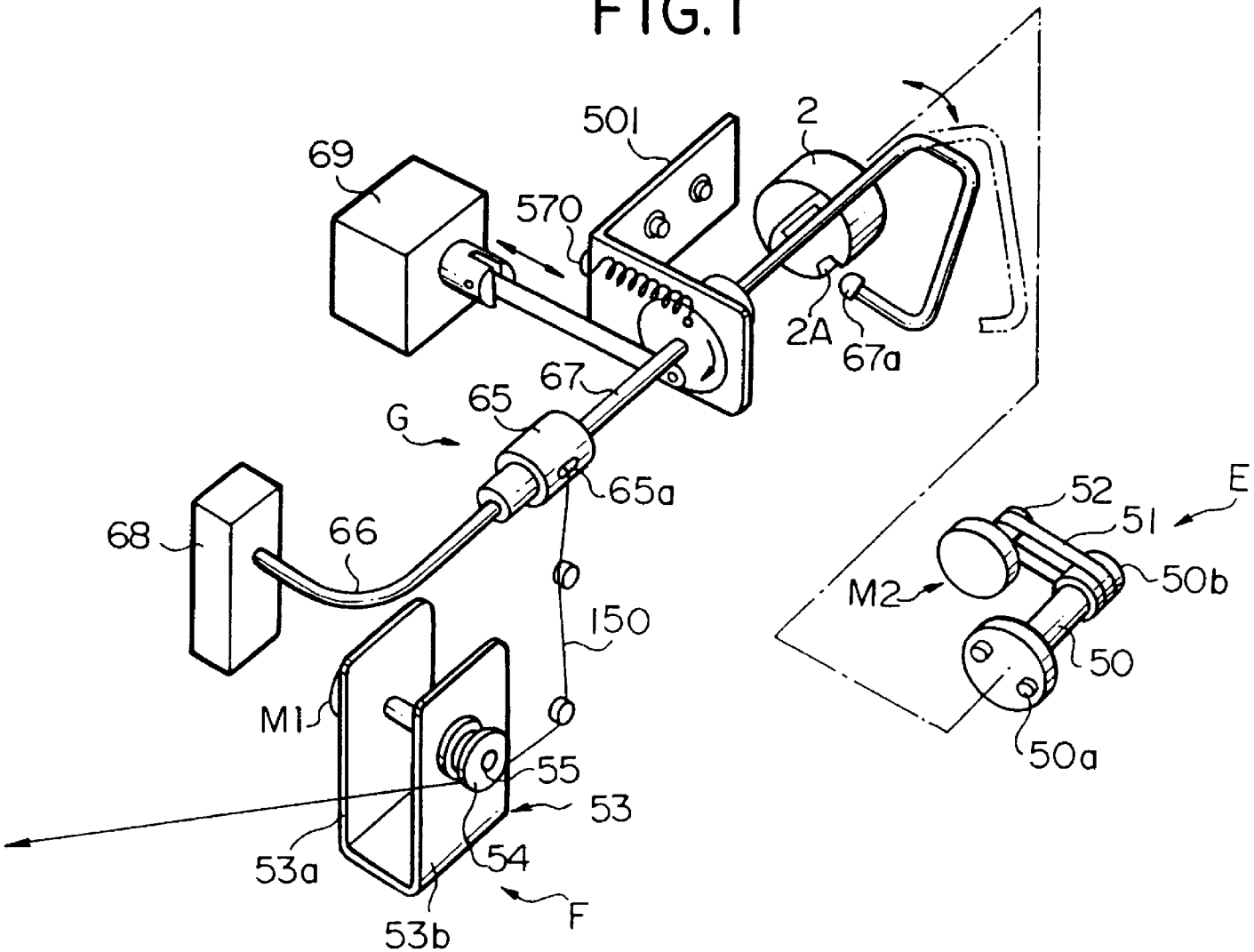
FIG. 1 is a schematic perspective view of a lower-thread winder of the present invention without thread stringing and cutting means.
Figure 10:
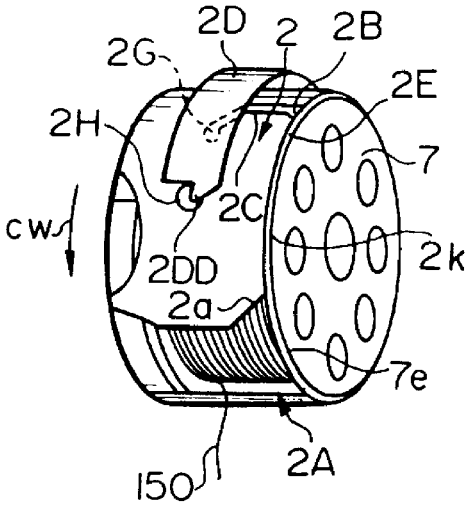
FIG. 10 is a perspective view of the bobbin case for use with the lower-thread winder shown in FIG. 1.

First, a description will be given of the bobbin drive mechanism E. Referring to FIG. 1, numeral 50 denotes a wind shaft which is rotatably supported by a base (not shown). Secured upon one end of the wind shaft 50 is clutch 50*a* which is clutchable with a plurality of holes formed upon the bobbin 7 (see FIG. 10). On the other end of the wind shaft 50, pulley 50*b* is fixed. Bobbin driver motor M2 which drives or rotates the bobbin is secured upon the base. Pulley 52 is fixed around an output shaft of the bobbin driver motor M2, and belt 51 is spanned between the pulleys 52 and 50*b*.

The bobbin case 2 is transferred to the lower-thread winding position C as the rotary arm 70 rotates, and then advanced as the rotary arm 70 advances. As the bobbin drive motor M2 is driven and the wind shaft 50 rotates, the clutch 50*a* and the bobbin 7 rotate together. Although the clutch 50*a* uses a pair of projections engageable with holes on the bobbin 7 in the instant embodiment, the clutch 50*a* may employ any other mechanical and/or electronic structures as long as it is connectable with the bobbin 7.

Figure 2:
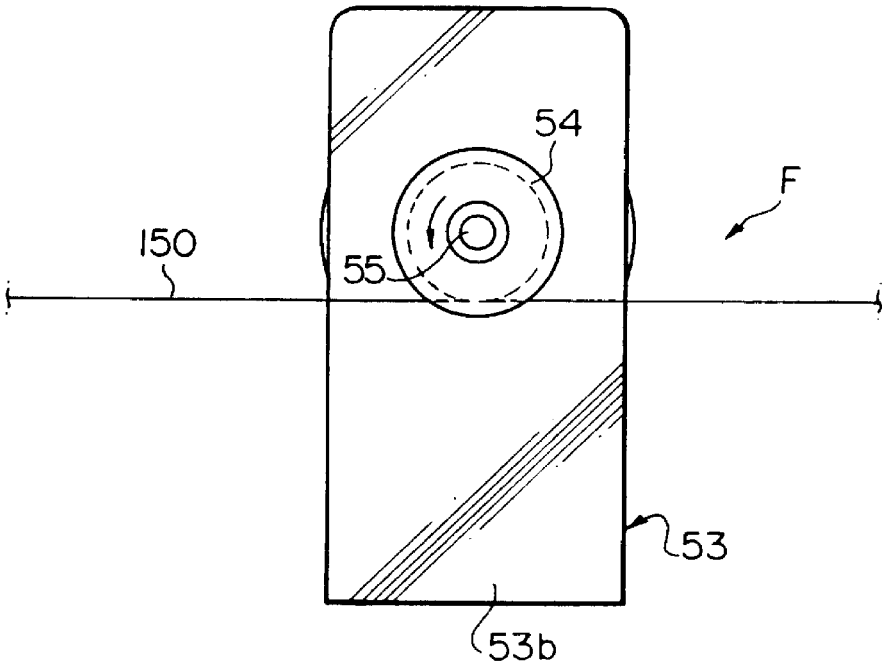
FIG. 2 is a right side view of a drawing mechanism of the lower-thread winder shown in FIG. 1.
Figure 3:
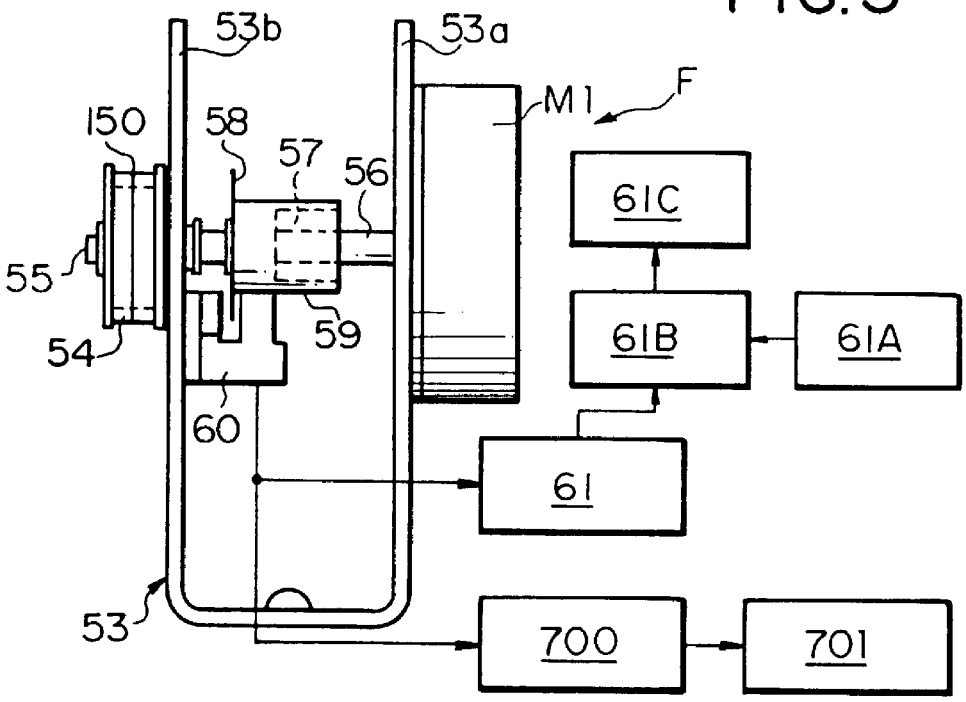
FIG. 3 is a rear side view of the drawing mechanism of the lower-thread winder shown in FIG. 1 and a block diagram connected to the drawing mechanism.

A description will now be given of the drawing mechanism F. Referring to FIGS. 1 through 3, drawing motor M1 is fixed on one side plate 53*a* of U-shaped base 53, and has output shaft 56 which perforates through the side plate 53*a*. The drawing motor Ml is set to be slower than the bobbin drive motor M2. On the other side plate 53*b* of the base 53, drawing roller shaft 55 is rotatably supported while axially aligned with output shaft 56 of the drawing motor M1. The drawing roller shaft 55 supports drawing roller 54 around which the lower thread 150 is wound once from the spool 200. One-way clutch 57 is provided between the shafts 55, 56 and installed into sleeve 59 with sensor slit 58, connecting and disconnecting the shafts 55 and 56. Notably, the one-way clutch 57 disconnects or shuts off the rotating output shaft 56 of the drawing motor M1 from the drawing roller shaft 55 when the rotation speed of the output shaft 56 exceeds that of the drawing roller shaft 55.

The sensor slit 58 has a disc shape with a plurality of grooves at its circumference. Photo sensor 60, opposite to the sensor slit 58, functions as a detector for detecting the amount of supplied lower-thread. The photo sensor 60 detects the number of grooves of the sensor slit 58, and the number of rotations of the drawing roller 54.

The photo sensor 60 of the drawing mechanism F is connected to effective rewind amount detector 61 which detects the entwinement of the lower thread 150 around bobbin shaft 7*a* and the effective amount of the lower thread 150 wound around the bobbin shaft 7*a*. The effective rewind amount detector 61 is connected to judgement unit 61B which compares the rewind amount set by rewind amount setting unit 61A, with the actual rewind amount around the bobbin sent from the effective rewind amount detector 61, and sends a drive stop signal to driver 61C of the bobbin drive motor M2 when both the amounts equal each other.

Figure 11:
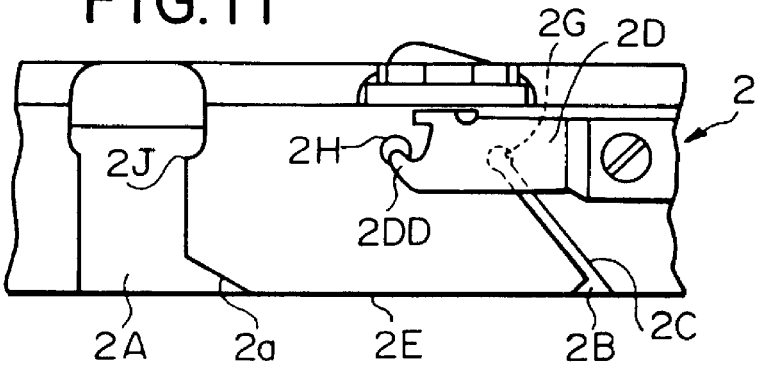
FIG. 11 is an exploded view of the bobbin case shown in FIG. 10.

The photo sensor 60 is also connected to stringing evaluation unit 700 which checks if the bobbin case 2 is strung with a desired condition. The stringing evaluation unit 700 includes a pulse counter (not shown) which counts the number of pulses from the photo sensor 60. The stringing evaluation unit 700 evaluates the stringing condition by comparing the counted number of pulses and the set number which has been stored in an unillustrated RAM. This evaluation is conducted after the lower thread is guided to slit 2C (see FIGS. 10 and 11) by working tool 116, the stringing operation is completed, and the slacks of the thread between the bobbin 7 and the spool 200 are eliminated, which will be detailed later.

In addition, the stringing evaluation unit 700 evaluates the stringing condition after the working tool 116 catches and guides the lower thread to a position below tension spring top 2DD through guide hole 2G (see FIGS. 10 and 11), and fixed cutter 91 cuts the lower thread (see FIGS. 17 and 18), which will also be detailed later.

The string evaluation unit 700, which prompts to retry when the stringing results are unsatisfactory, executes a predetermined number of stringing operations until it detects a satisfactory result. The string evaluation unit 700 may be connected to error indicator 701, such as a warning lamp, which warns the operator of an abnormality after a predetermined number of unsatisfactory retrials, which will also be described later.

Next follows a description of the air guide unit G. Referring to FIG. 1, numeral 65 denotes a thread absorber of an approximate hollow cylinder shape located between air tubes 66, 67.

Figure 5:
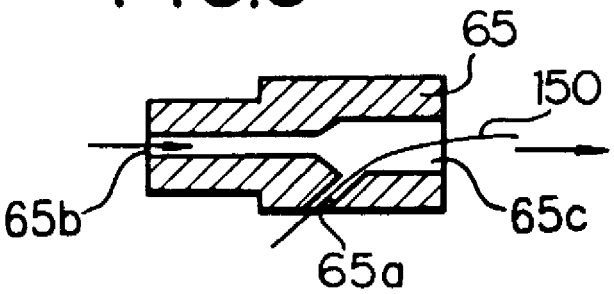
FIG. 5 is a lateral section of a thread absorber used for the lower-thread winder shown in FIG. 1.

The thread absorber 65 has attraction hole 65*a*, inlet 65*b*, and outlet 65*c*. The attraction hole 65*a* is for absorbing the lower thread 150 in the thread absorber 65. The attraction hole 65*a* connects the inner space and the outer space of the thread absorber 65 and is inclined in section, as shown in FIG. 5, so as to lead the lower thread 150 to the air tube 67. An arrow in FIG. 5 indicates an air flow.

The inlet 65*b* is connected to the air tube 66. The air tube 66 is connected to electromagnetic valve 68 connected to an unillustrated air source. The electromagnetic valve 68 is equipped with a unillustrated rewind switch which turns on and off the electromagnetic valve 68.

Figure 7:
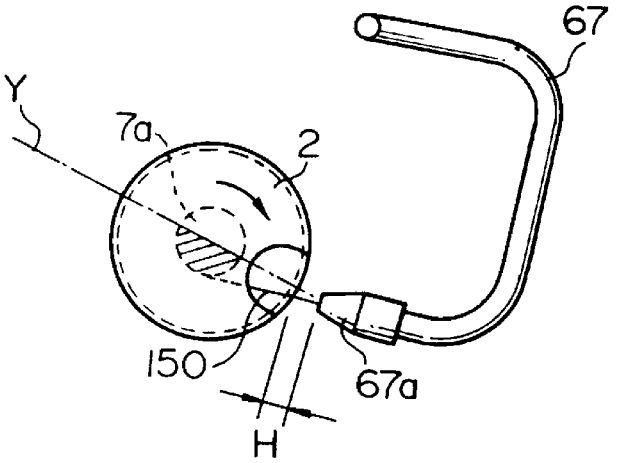
FIGS. 7 and 8 are views for explaining an arrangement among a bobbin case, a bobbin shaft, and an air nozzle when the lower thread entwines around the bobbin shaft.
Figure 8:
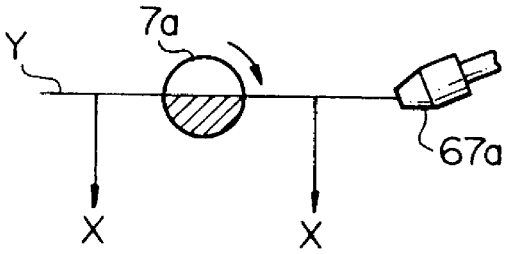

The air tube 67 is connected rotatably with the thread absorber through the outlet 65*c*. The air tube 67 includes an L-shape end with air nozzle 67*a*, which is able to be opposite to the opening 2A of the bobbin case 2 when the clutch 50*a* is engaged with the bobbin 7. The air nozzle 67*a* is arranged in a direction forward to the rotary direction of the bobbin shaft 7*a*. In other words, as shown in FIGS. 7 and 8, if line Y is created by connecting the top of the air nozzle 67*a* and the center of the bobbin shaft 7*a*, the lower thread 150 is positioned under the line Y or at side X to be easily wound around the bobbin 7. The lower thread 150 preferably crosses the circumference of the bobbin shaft 7*a*, and more preferably corresponds to the tangent of the bobbin shaft 7*a*.

When the electromagnetic valve 68 is turned on, air from the air source flows through the air tube 66, the thread absorber 65, the air tube 67 and finally the air nozzle 67*a*. Interval H between the top of the air nozzle 67*a* and the opening 2A of the bobbin case 2 is preferably 10 mm or less, and more preferably 3–7 mm (see FIG. 7). This range of interval H effectively flaps the lower thread 150 through the blowoff air and forms a vortex flow to entwine the lower thread 150 around the bobbin shaft 7*a*.

As shown in FIG. 1, a part of the air tube 67 is rotatably supported by base 501 of the lower-thread winder 162. The air tube 67 is forced counterclockwise ("CCW" in the drawings) in FIG. 1 by the force of spring 570 and is rotatable against the force of spring 570 when solenoid 69 is driven. Therefore, when the solenoid 69 is turned on, the air nozzle 67*a* is rotated clockwise ("CW" in the drawings) against the force of spring 570 to oppose to the opening 2A; when the solenoid 69 is turned off, the air nozzle 67*a* is evacuated from the opening 2A by the force of spring 570. The air nozzle 67*a* is rotated at a position opposite to the opening 2A when the lower thread 150 is to be entwined around the bobbin shaft 7, and evacuated from the opening 2A during the lower-thread winding, stringing, and cutting periods.

Figure 9:
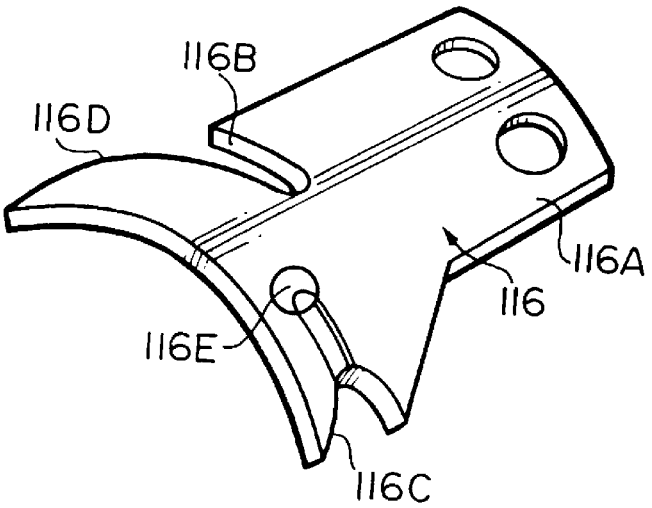
FIG. 9 is a perspective view of a working tool which functions as the thread stringing and cutting means of the lower-thread winder shown in FIG. 1.
Figure 13:
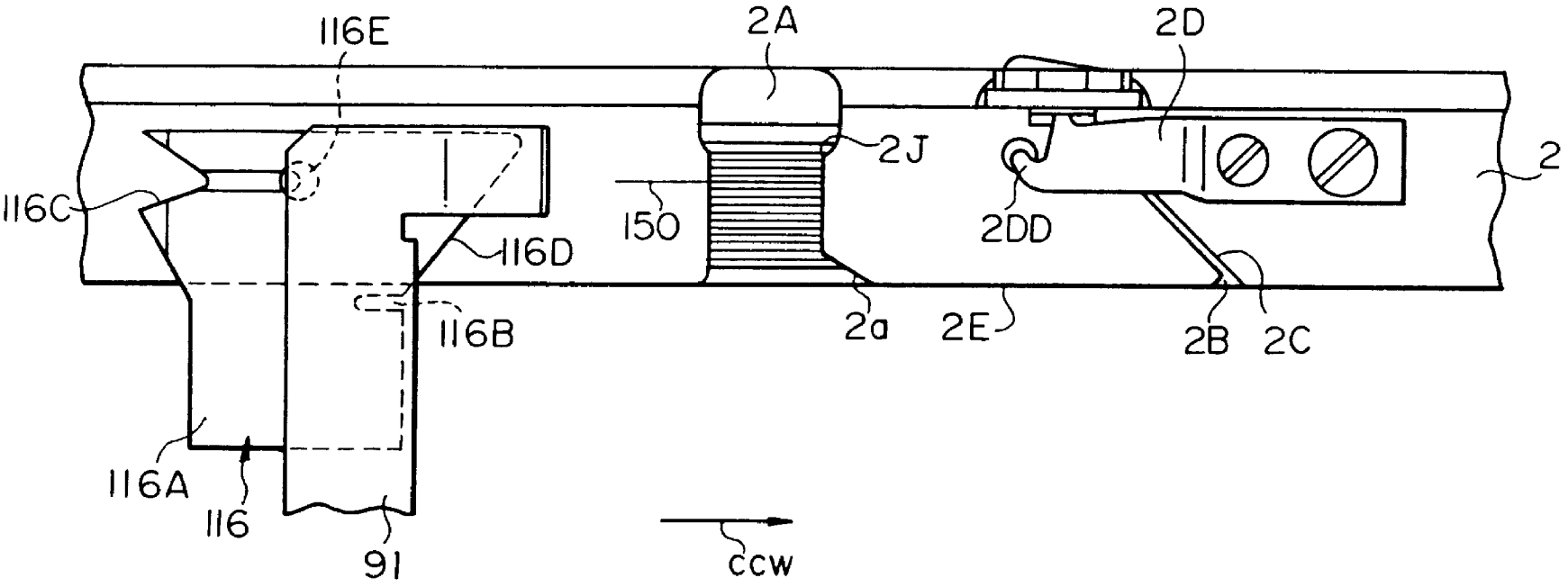
FIGS. 13–16 are views for explaining how the working tool shown in FIG. 9 strings the bobbin case with the lower thread shown in FIG. 7.
Figure 30:
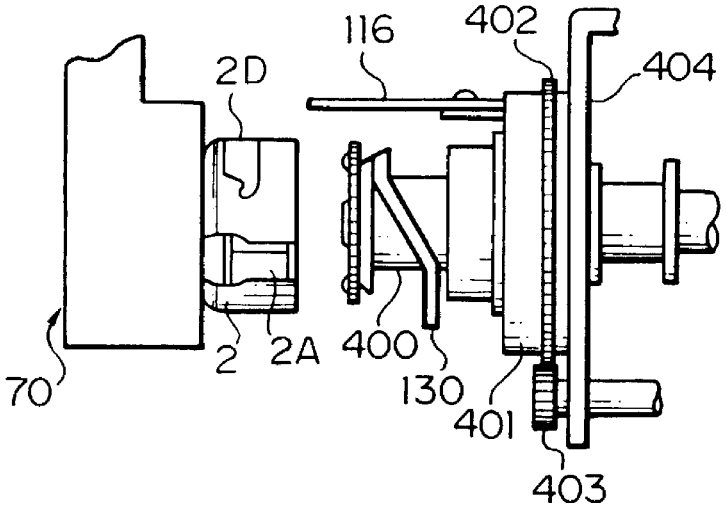
FIG. 30 is one example of a mechanism for driving the working tool shown in FIG. 12.

The working tool 116 is located near the bobbin case 2 which is set to the lower-thread winding position C. The working tool 116 functions as threading or stringing means, thread cutting means, and thread grasping means. As shown in FIGS. 9 and 13, the working tool 116 includes slope 116D which leads the lower thread 150 from the opening 2A towards opening end 2E (see FIGS. 10 and 11) during the stringing period; U-shaped cutout 116B which catches the lower thread 150 guided by the slope 116D; V-shaped cutout 116C which leads and grasps the lower thread 150 during the thread cutting period; and mobile cutting plate 116A. As shown in FIGS. 9 and 13, the root of the cutout 116B is offset from that of the cutout 116C. Cutting eye (or mobile cutter) 116E is provided on the mobile cutting plate 116A and at the circumferential extension of the root of the cutout 116C. The mobile cutting plate 116A is formed as an arc-shape corresponding to the wind shaft 50 (see FIGS. 9 and 18). When the working tool 116 rotates around the bobbin case 2 to the fixed cutter 91 as thread cutting means, the mobile cutter 116E rubs against the top of the fixed cutter 91. As shown in FIG. 30, the working tool 116 is rotatably supported on wind shaft 400. The wind shaft 401 holds gear 402 to be driven by driving gear 403. The wind shaft 401 is fixed onto plate 404 which is secured onto the base plate 3.

The working tool 116 is rotated by a motor (not shown) which is rotatable forward and backward through a plurality of gears 402, 403. As the motor rotates, the working tool 116 is rotate in the forward direction and backward direction.

The bobbin case 2, the fixed cutter 91, and cutting point S which is defined by a rubbing point between the mobile cutter 116E and the fixed cutter 91, are arranged so that after the winding and stringing operations, which will be discussed later, the lower thread 150 can be led from the tension spring top 2DD through the guide hole 2G under the tension spring 2D. The length from the tension spring top 2DD to the cutting point S is set to be long enough to form a seam with upper thread, e.g., around 40 mm.

Figure 12:
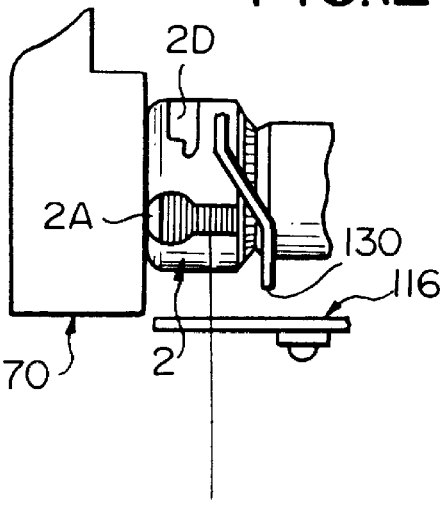
FIG. 12 is a side view of the essential portion of the lower-thread winder which has wound the lower thread.
Figure 16:
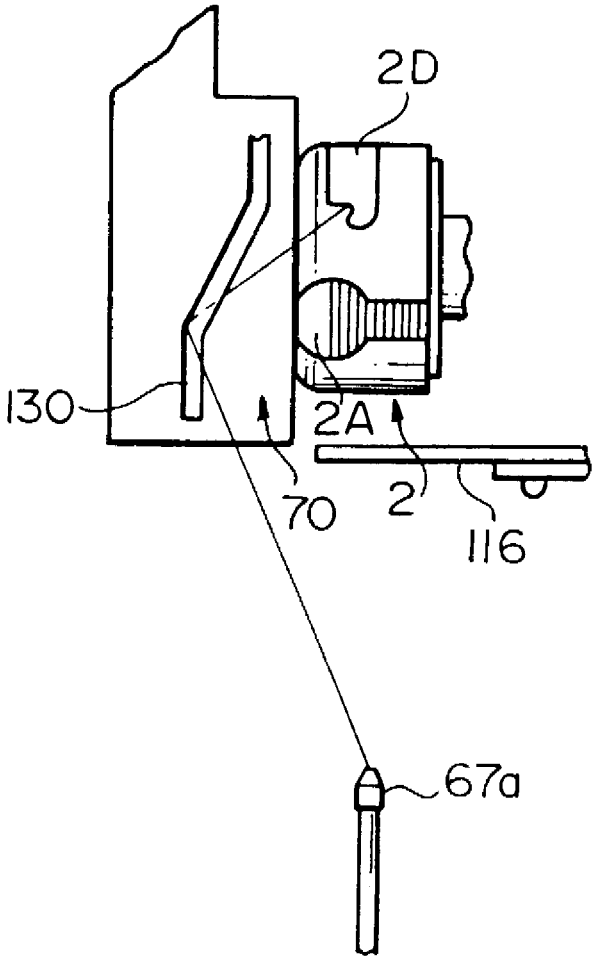
Figure 28:
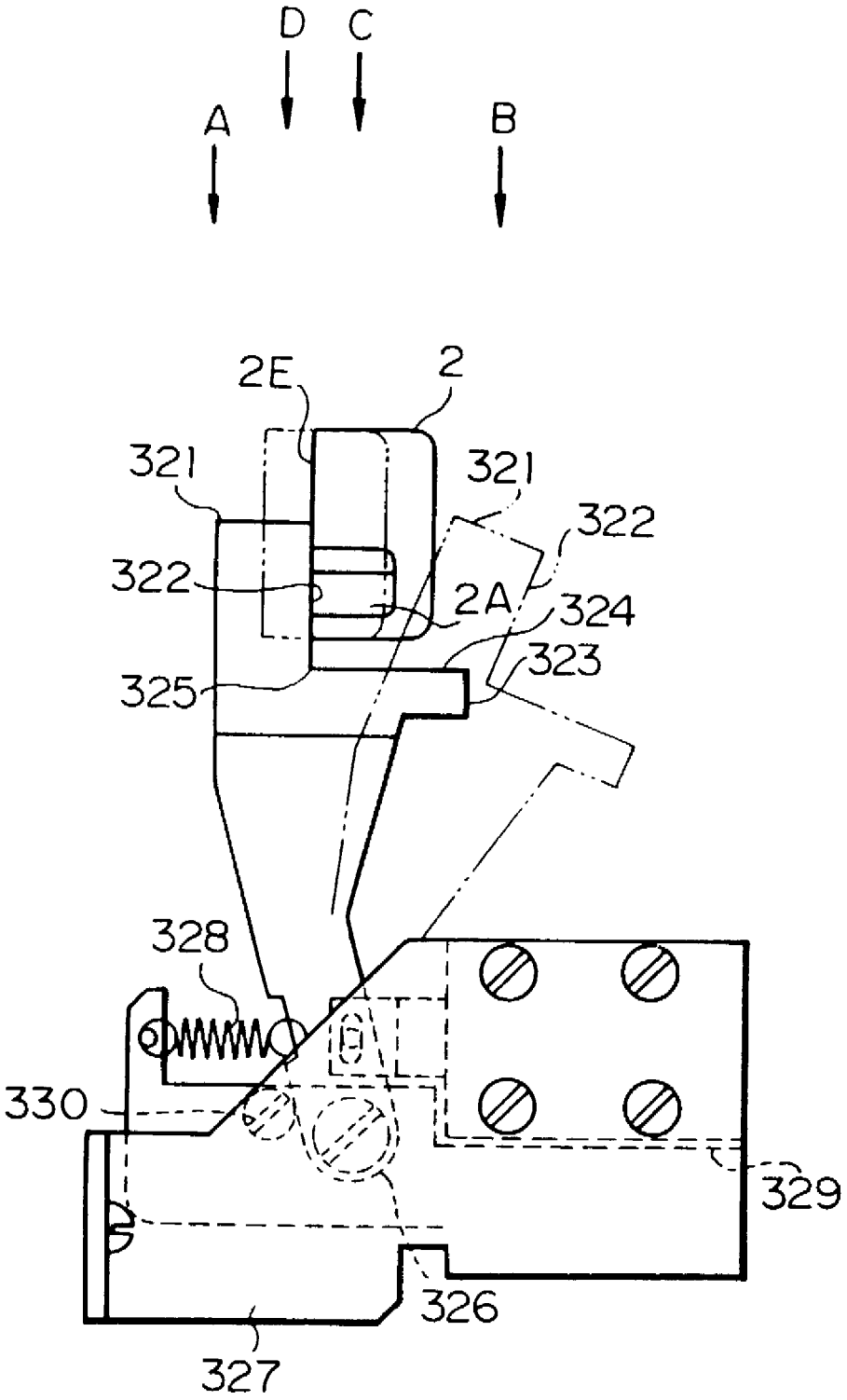
FIG. 28 is a front view of one example of a wiper which constitutes stringing means of the lower-thread winder in cooperation with the working tool shown in FIG. 12.
Figure 29:
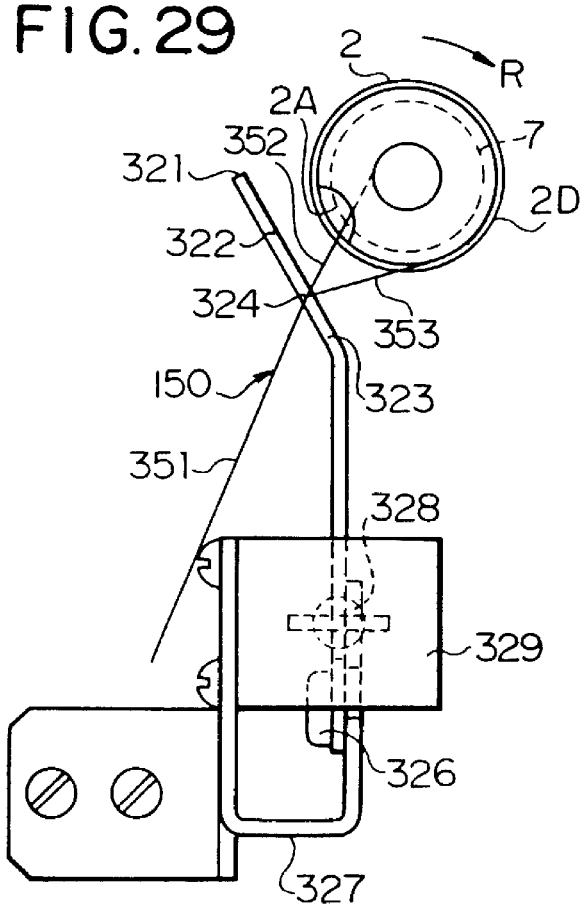
FIG. 29 is a side view of the wiper shown in FIG. 28.

Referring FIGS. 12 and 16, wiper 130 for use with a rotatably supported stringing unit is opposite to the top of the wind shaft 50. A description will now be given of one example of the wiper 130 with reference to FIGS. 28 and 29. FIG. 28 is a front view of the wiper 130, and FIG. 29 is a side view.

As illustrated in these drawings, the wiper 130 is made of bent plate and integrated with L-shaped thread guide 323 at the top thereof. The thread guide 323 is defined by hook 322, guide edge 324, and corner 325. As detailed later, in an attempt to string the bobbin case 2, the lower thread 150 is first led to the slit 2C by the working tool 116. Then, the guide 323 touches the lower thread 150 at the slit 2C, and the guide edge 324 leads the lower thread 150 to a position under the tension spring 2D. The guide edge 324 has an arc shape in section so as to smoothly guide the lower thread 150 without cutting the thread 150. The wiper 130 is secured at a proximal end thereof onto frame 327 by stepped screw 326, and is pivotable around stepped screw 326. The wiper 130 is forced counterclockwise in FIG. 29 by extension spring 328 connected to the frame 327, while restricted by stopper 330. Numeral 329 is a solenoid which functions as an actuator for the wiper 130. The wiper 130 integrated with thread guide 323, solenoid 329, and other components are attached as one unit to the frame 327, and also secured onto a main frame (not shown).

Thread path 351 changes to path 352 during the thread rewind period, and path 353 during the thread string period.

As shown in FIG. 28, the wiper 130 is normally located at position A. During the winding period, the guide edge 324 rotates the lower thread 150 in the reverse direction with respect to the bobbin case 2. At this time, the bobbin case 11 is normally located at the position C shown in FIG. 4.

In the thread string operation, the lower thread 150 is led to the slit 2C of the bobbin case 2, as detailed later. Then, the rotary arm 70 transfers the bobbin case 2 in the axial direction up to position D in FIG. 28. Subsequently, the solenoid 329 is energized and the wiper 130 is rotated clockwise in FIG. 28 to position B in FIG. 28.

During this operation, the hook 322 of the wiper 130 (or more particularly the corner 325) transfers the lower thread 150 in the bobbin-shaft direction, leading the lower thread 150 to the position under the tension spring 2D. When the solenoid 329 is turned off, the wiper 130 returns to the original position A by the extension spring 328 and stops there by the stopper 330.

Alternatively, the wiper 130 may comprise a bent rod which is rotatable by a rotary air cylinder (not shown).

Figure 4:
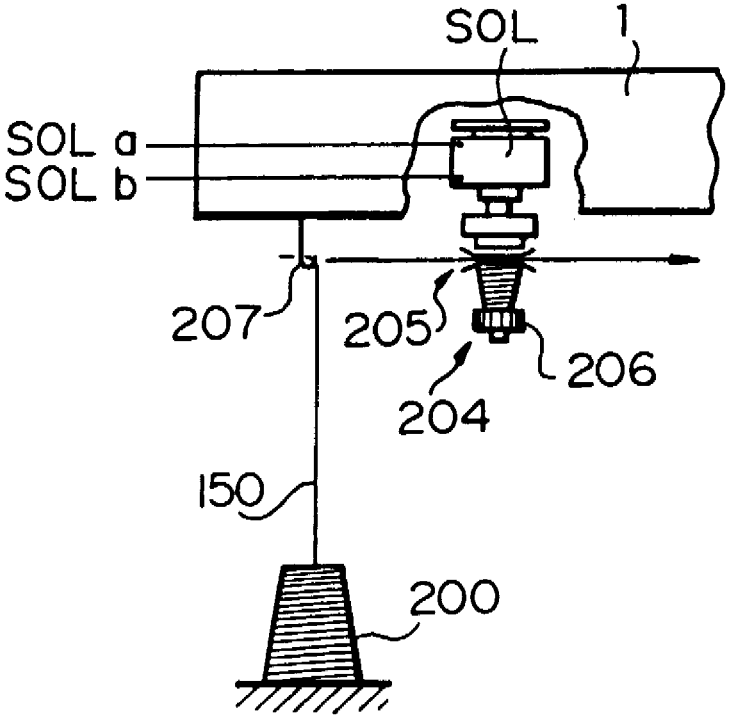
FIG. 4 is a front view of a tension adjuster applied to the lower-thread winder shown in FIG. 1.

Tension adjuster 204, which varies the tension of the lower thread 150, is provided between the mechanism F and the spool 200, as shown in FIG. 4. The tension adjuster 204 includes tension spring 205 which compresses the passing lower thread 150; screw 206 which regulates the compression force of the tension spring 205 by a manual operation; and solenoid SOL, provided in the sewing-machine bed 101, which produces thrust against the compression force of the tension spring 205. An electric circuit which drives the tension adjuster 204 comprises power source V connected in series to the solenoid SOL, and a switch provided between them.

Thus, when the switch is turned off, the solenoid thrust is not generated and the maximum compressional force of the tension spring 205 is applied to the lower thread 150, maximizing the thread tension. When the switch is turned on, the maximum solenoid thrust is generated and the minimum tension, i.e., a substraction of the solenoid thrust from the compressional force of tension spring 205, is applied to the lower thread 150, minimizing the thread tension.

If the remaining-thread remover 161 and/or lower-thread winder 162 collide with the base plate 3 in FIGS. 22 to 27, the base plate 3 is properly notched. In addition, FIG. 22 illustrates that the removing-thread removing position B, the lower-thread winding position C, and the loading/ejecting position D are close to one another, and exaggerates the bobbin-case grip unit. Therefore, there might be a concern that the bobbin-case grip unit may crash into the remaining-thread remover 161 and/or the lower-thread winder 162. However, the concrete device maintains sufficient space for and among them and eliminates such a concern.

In the instant embodiment, the bobbin-case grip unit is transferable between the loading/ejecting positions A and D and the opposing evacuation positions (see FIGS. 21 through 25). When the bobbin-case grip unit is transferred to the evacuation position, the sensor plate 15 shields the path between the light emitting element 41*a* and light receiving element 41*b* of the linear sensor 41, thereby detecting the movement of the bobbin-case grip unit to the evacuation position. Then, an origin is retrieved at the evacuation position: If the position where the sensor plate 32 shields the path between light emitting element 31*a* and light receiving element 31*b* is set to be the origin, the bobbin-case grip unit is rotated at the evacuation position until it reaches that position; consequently the bobbin-case grip unit is reset to the origin. If a pulse motor is used for the rotary motor 20, the bobbin-case grip unit is controlled in rotation among the shuttle position A, lower-thread winding position C, remaining-thread removing position B, and dummy position D by counting the number of pulses of the pulse motor.

A description will be given of the operation of the automatic lower-thread feeder. In an attempt to hold the bobbin case with a fully wound bobbin by the bobbin-case grip unit, the operator puts his/her hand into the sewing machine from the rotary arm 70 side in the same manner as he/she loads the bobbin case into the middle-shuttle shaft 5, and pushes the bobbin case into the dummy shaft 6 without turning his/her palm, loading the bobbin case into the dummy shaft 6. For convenience, this bobbin case will be designated by numeral 2X and distinguished from bobbin case 2Y which will appear later.

When the power switch is turned on, the rotary arm 70 is reset to the origin. When the start switch is turned on, the rotary arm 70 is rotated and one of the bobbin-case grip units is opposed to the bobbin case 2X held at the dummy position D. Next, the rotary arm 70 is advanced to hold the bobbin case 2X with a fully wound bobbin by the bobbin-case grip unit. The other bobbin-case grip unit is, on the other hand, transferred to the shuttle 1 without interfering with any obstacles.

Thus, when the dummy shaft 6 is provided opposite, with respect to the carrier shaft 4, to the remaining-thread removing position B or the lower-thread winding position C, and one of the bobbin-case grip units is transferred to the dummy shaft 6, the other bobbin-case grip unit will crash into the remaining-thread remover 161 and/or the lower-thread winder 162 since the positions B and C are located at or near the evacuation position of the bobbin-case grip unit in the carrier-shaft direction. On the contrary, the present invention successfully eliminates such a problem by configuring the dummy shaft 6 at a position opposite to the rotating bobbin-case grip unit and below the shuttle 1.

Turning back to the operation, the rotary arm 70 is retreated and rotated to a position opposite the shuttle 1 and the bobbin-case grip unit which holds the bobbin case 2X. Subsequently, the rotary arm 70 is advanced, and the bobbin case 2X is loaded into the shuttle 1. Then, the other bobbin-case grip unit is transferred to the dummy shaft 6 without any interfering obstacles, and the rotary arm 70 is then retreated. The operator then puts his/her hand into the sewing machine from the rotary arm 70 side in the aforementioned manner and loads the bobbin case 2Y, with a fully wound bobbin into, the dummy shaft 6.

After sewing is initiated, one of the bobbin-case grip units holds the bobbin case 2Y at the dummy shaft 6 and rotary arm 70 retreats during the sewing operation.

When a bobbin change command is issued, for example, because the remaining thread in the shuttle is insufficient, the sewing operation is interrupted, the bobbin-case grip unit is advanced to take out from the shuttle 1 the bobbin case 2X with a small amount of remaining thread bobbin, and the rotary arm 70 is then retreated.

The rotary arm 70 is then rotated to a position opposite the shuttle 1 and the bobbin case 2Y, which has a fully wound bobbin, and advanced to load the bobbin case 2Y into the shuttle 1. The rotary arm 70 is then retreated.

When the sewing operation is resumed, the rotary arm 70 is rotated, during the sewing operation, to transfer the bobbin case 2X to the remaining-thread removing position B. In response, the remaining-thread remover 161 completely removes the remaining thread from the bobbin in the bobbin case 2X.

Next, the rotary arm 70 is rotated to oppose the bobbin case 2X with the empty bobbin to the lower-thread winding position C. Then, the rotary arm 70 is advanced, whereby the lower-thread winder 162 rewinds the empty bobbin. Next follows an operation of the lower-thread winder 162 with reference to FIGS. 1 through 21.

First, the lower thread 150 is reeled once around the drawing roller 54, while guided from the spool 200 through the tension adjuster 204. The tension adjuster 204 has been switched on, maximizing the solenoid thrust and minimizing the tension of the lower thread 150.

Then, the edge of the once reeled lower thread 150 is inserted and squeezed into the absorption hole 65*a* of the thread absorber 65. Next, the drawing motor M1 is driven to draw the lower thread 150 and the electromagnetic valve 68 is temporality turned on to flow air through the air tubes 66 and 67 from the air source, thereby leading the lower thread 150 in the absorption hole 65*a* to the air nozzle 67*a* and exposing the edge of the thread 150 from the air nozzle 67*a*. Alternatively, it is conceivable to generate an air flow through the air tubes 67, 68 for a limited period by operating the unillustrated rewind switch, thereby automatically exposing the edge of the thread 150 from the air nozzle 67*a*.

When the bobbin case 2, which has been transferred to the lower-thread winding position C by the rotary action of the rotary arm 70, is advanced by the advance action of the rotary arm 70, the bobbin drive motor M2 is temporarily driven to connect the clutch 50*a* to the bobbin 7 and the solenoid 69 is turned on to oppose the air nozzle 67*a* to the opening 2A. The drawing motor M1 is driven to draw the lower thread 150, and the electromagnetic valve 68 is turned on to generate an air flow through the air tubes 67 and 68 from the air source. Thereby, the edge of the thread 150 exposed from the air nozzle 67*a* is led to the bobbin case 2 and a vortex flow is created in the bobbin case 2. Either simultaneous to this or somewhat after this, the bobbin drive motor M2 is driven to rotate the bobbin 7 (see FIGS. 6(*a*) through 6(*c*).

Figures 6A, 6B, 6C, 6D:
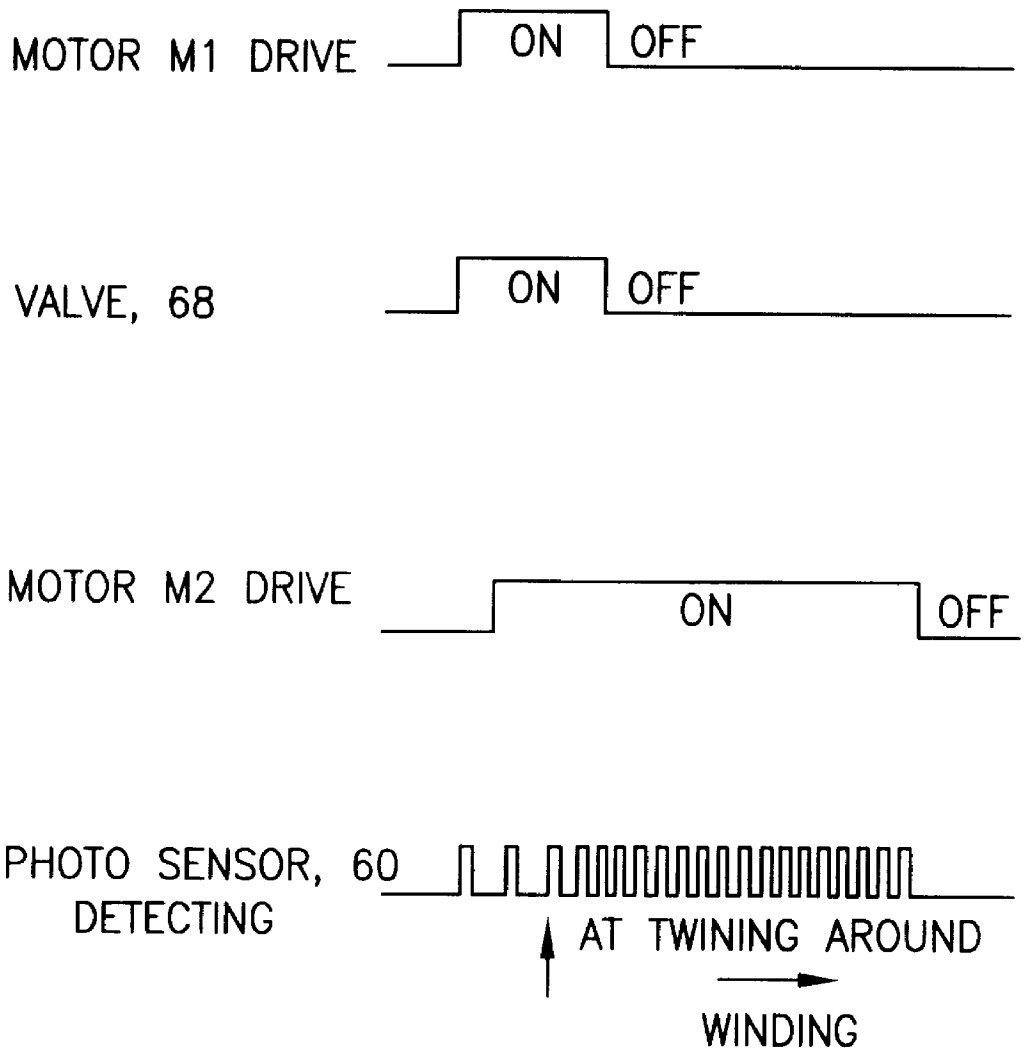
FIG. 6(*a*) is a timing chart for explaining operations of the lower-thread winder shown in FIG. 1.

As a result, the lower thread 150 led to the bobbin case 2 is entwined around the bobbin shaft 7*a* and thus started to be rewound around the bobbin shaft 7*a*. Although the rotation of the drawing roller 54 is detectable by the photo sensor 60, the rotation of the drawing motor M1 is observed until the lower thread 150 is entwined around the bobbin shaft 7*a*. Once the lower thread 150 entwines around the bobbin shaft 7*a*, the one-way clutch 57 disconnects the rotation of the output shaft 56 of the drawing motor M1 from the drawing roller shaft 55 since the rotational speed of the drawing motor M1 is set to be smaller than that of the bobbin drive motor M2, as discussed above. As a consequence, the drawing roller 54 is driven by the bobbin drive motor M2. This is observed from a signal detected by the photo sensor 60 since the signal changes to indicate narrower pulse intervals, as shown in FIG. 6(*d*).

Hereupon, the effective rewound amount detector 61 connected to the photo sensor 60 counts the number of pulses (i.e., the detected signal) within two consecutive reference clock pulses with a predetermined interval to detect a change in the detected signals. The entwinement of the lower thread 150 around the bobbin shaft 7*a* may be recognized by detecting the change in the detected signals, and the amount of wound lower thread 150 subsequent to the entwinement may be considered as the effective rewind amount of the lower thread 150.

Once the entwinement of the lower thread 150 is detected by the effective rewind amount detector 61, the drawing motor M1, the electromagnetic valve 68, and the solenoid 69 are turned off whereby the air nozzle 67*a* is evacuated from the opening 2A. As the air nozzle 67*a* moves away from the bobbin shaft 7*a*, the lower thread 150 may be wound approximately uniformly around the entire area of the bobbin shaft 7*a*.

The rewind continues by increasing the rotational speed of the bobbin drive motor M2 so as to shorten the time to rewind the thread 150 around the bobbin shaft 7*a*. However, it is optional to increase the rotational speed of the bobbin drive motor M2. When the predetermined number of rotations representative of the predetermined amount of lower thread is detected, the bobbin drive motor M2 is stopped.

When the automatic rewind is completed, the tension adjuster 204 is switched off to remove the solenoid thrust and maximize the thread tension. Next, the bobbin case 2 is automatically strung or threaded by the lower thread 150 projecting from the opening 2A. The threading or stringing operation will be discussed below with reference to FIGS. 20 and 21.

FIGS. 12, 13, and 18A show a completed state of the rewind operation by the lower-thread winder 162; this state is an initial state for the threading or stringing operation. In this state, the cutout 116B of the working tool 116 is positioned, as shown in FIG. 13, outside the opening end 2E (or under the opening end 2E in FIG. 13), and the clutch 50*a* and the bobbin 7 are connected to each other.

Figure 14:
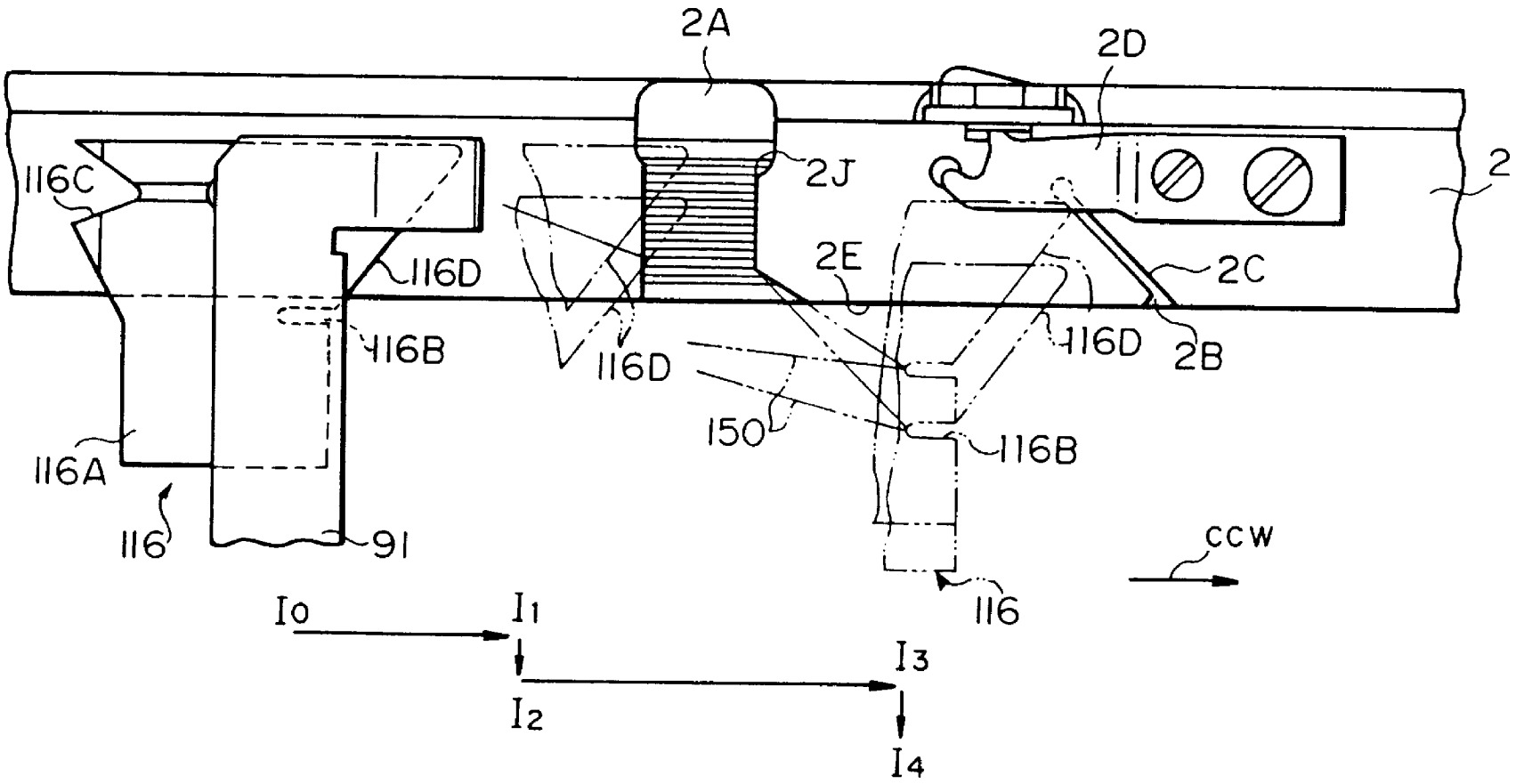

First, step 1 rotates the working tool 116 counterclockwise from initial position $I_0$ shown in FIGS. 12, 13, 14 and 18A to position $I_1$ shown in FIGS. 14 and 18B. At the position $I_1$, the slope 116D comes to the opening 2A, and touches or catches the lower thread 150 extending from the opening 2A.

In step 2, the rotary arm 70 retreats in the axial direction so that the working tool 116 may move from the position $I_1$ to position $I_2$ in FIG. 14. Thus, the working tool 116 approaches the opening end 2E while catching and guiding the grasped lower thread 150 to the opening end 2E by the slope 116D.

In step 3, the working tool 116 is further rotated counterclockwise from position $I_2$ to the position $I_3$ in FIG. 14 (see also FIG. 18C). The lower thread 150 extending from the opening 2A is now caught by the cutout 116B through the slope 116D while guided to aperture 2K shown in FIG. 10 between the opening end 2E and bobbin circumference 7*e*.

In step 4, the rotary arm 70 retreats in the axial direction so that the working tool 116 may move from the position $I_3$ to position $I_4$ in FIG. 14. Thereby, the working tool 116 further approaches the opening end 2E whereby the connection between the clutch 50*a* and the bobbin 7 is released.

Figure 15:
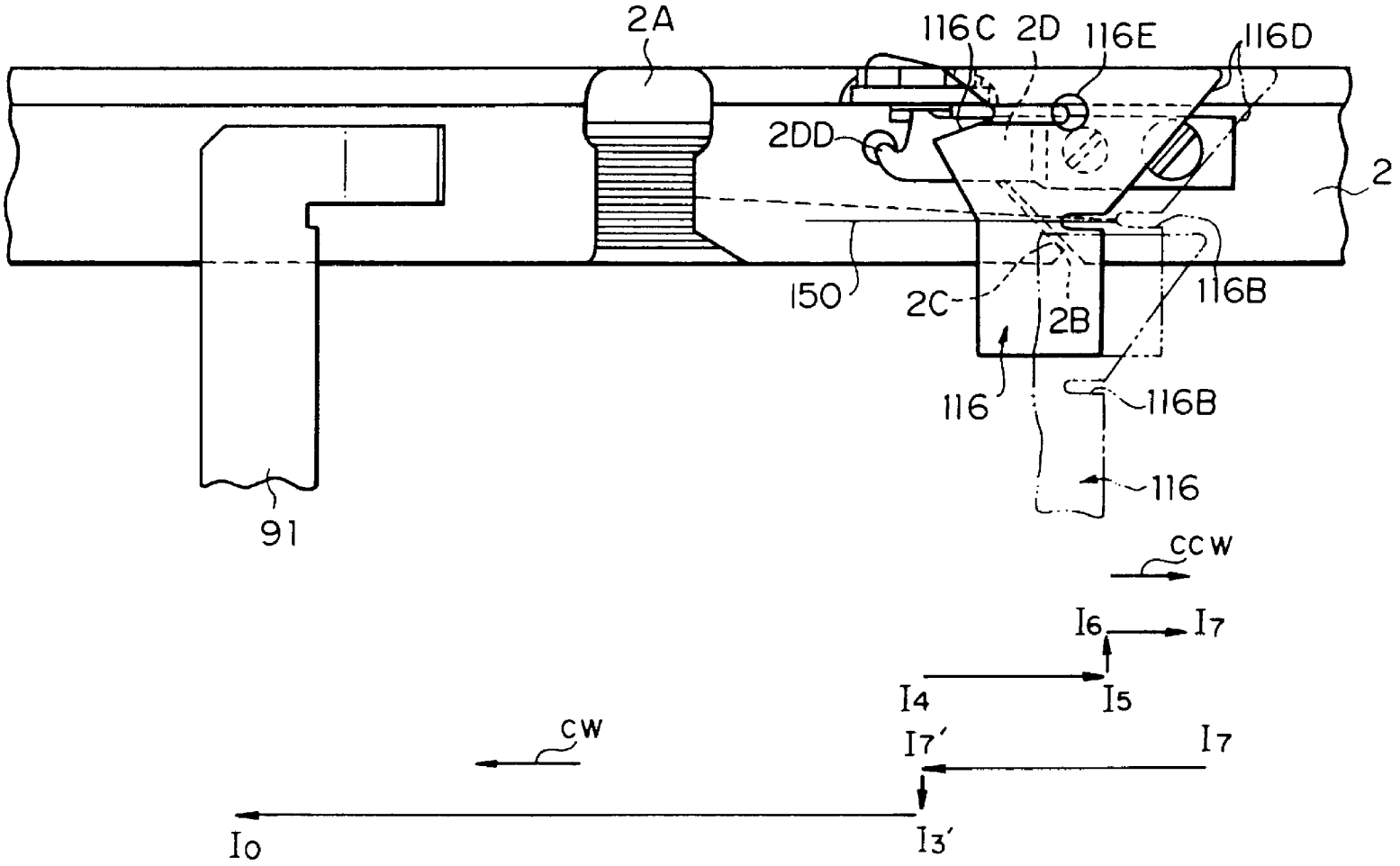

In step 5, the working tool 116 is further rotated counterclockwise from the position $I_4$ to position $I_5$ shown in FIG. 15. At the position $I_5$, the cutout 116B is positioned at the side (or under in FIG. 15) of stringing position 2B, which is an entrance to the slit 2C. This rotation enables the lower thread 150 to pass through the aperture 2K successfully.

As the lower thread 150 advances through the aperture 2k, the tension applies to the lower thread 150 around the bobbin 7 and induces the bobbin 7 to rotate. Hereupon, if the bobbin drive motor M2 was connected to the bobbin 7 through the clutch 50*a*, load would apply to the bobbin 7 and the bobbin 7 might be prevented from smooth rotation. As a result, the lower thread 150 might be prevented from successful movement through the aperture 2K and the stringing operation might fail. Such a risk increases when bobbin 7 has a large amount of lower thread 150. On the other hand, the instant embodiment successfully passes the aperture 2K by disconnecting the clutch 50*a* from the bobbin 7 in advance.

In addition, if the working tool 116 was rotated counterclockwise from the positions $I_0$ to $I_3$ linearly without intervening step 2, the lower thread 150 might get hooked by edge 2J at the opening 2A, lifted on the bobbin case 2, and fail to pass the aperture 2k successfully. On the other hand, the instant embodiment intervenes the step 2 and eliminates this problem.

In step 6, the rotary arm 70 advances in the axial direction so that the working tool 116 may move from the position $I_5$ to position $I_6$ in FIG. 15, whereby the clutch 50*a* is connected to the bobbin 7 and the cutout 116B is located above the bobbin case 2. As the working tool 116 moves in the upper direction in FIG. 15, the lower thread 150 near the stringing position 2B while caught by the cutout 116*b* is guided into the slit 2C from the stringing position 2B.

In step 7, the working tool 116 is further rotated counterclockwise from the position $I_6$ to position $I_7$ in FIG. 15. At the position $I_7$, the cutout 116B has gone beyond (or at the right side, in FIG. 15, of) the slit 2C.

Hereupon, if the working tool 116 was rotated counterclockwise from the position $I_4$ to $I_7$ linearly, it would be impossible to guide the lower thread 150 to the slit 2C, or an additional device would be required which compulsorily guides the lower thread 150 to the slit 2C as disclosed in Japanese Patent Application No. 6-64456. On the other hand, the instant embodiment intervenes the movement of the working tool 116 from the position I5 to I6, and successfully guides the lower thread 150 to the slit 2C without such an additional device.

In step 8, the working tool 116 is rotated clockwise from the position $I_7$ to the position $I_7'$ in FIG. 15, then transferred from the position $I_7'$ to position $I_3'$ by retreating the rotary arm 70 in the axial direction (see FIG. 18D), and finally rotated clockwise from the position $I_3'$ to the initial position $I_0$ (see FIG. 18E).

As a result of the step 7, which guides the lower thread 150 to the slit 2C, slacks occur in the lower thread 150 since the cutout 116B has passed off the slit 2C. In order to remove possible malfunctions caused by the slacks, a slack removing operation is conducted as follows (see step 9).

Figure 19A:
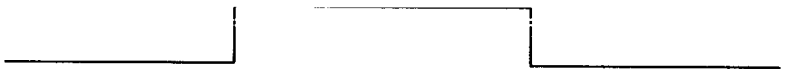
FIGS. 19A–19D are timing charts for explaining the thread stringing operation and the thread cutting operation, and the number of lower-thread supplied pulses to be detected during the above operations.
Figure 19B:
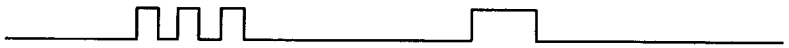
Figure 19C:
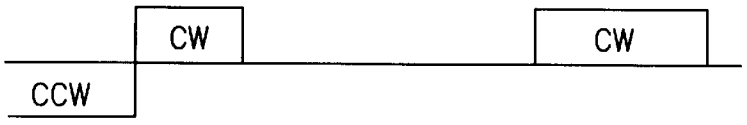

As shown in FIGS. 19B and 19C, while the working tool 116 is rotated clockwise and reset from the position $I_7$ to the position $I_0$, the bobbin drive motor M2 is driven intermittently or continuously in a direction to remove slacks of the lower thread 150, i.e., the same direction as the rewind direction.

According to the instant embodiment, the bobbin 7 is intermittently or continuously rotated for a predetermined period even after the slacks of the lower thread 150 are removed, preferably, until the working tool 116 is reset from the position $I_7$ to the position $I_0$. As a consequence, the tension applies to the spool 200 to make it supply the lower thread 150, and the threading or stringing condition is checked by comparing the number of pulses output from the photo sensor 60, more specifically, the number of pulses output from the pulse counter connected to the photo sensor 60, with the ideal or expected number of lower-thread supplied pulses which has been stored in a data table in the RAM (as a real line) in FIG. 19D (in step 10).

Therefore, if the lower thread 150 from the opening 2A should pass off the stringing position 2B without getting guided to the slit 2C as the working tool 116 moves from the position $I_0$ to the position $I_7$, the lower thread 150 would have more slacks than as normally guided. As a consequence, the detected number of lower-thread supplied pulses becomes smaller, such as $S_{1f}$ on one dot line in FIG. 19D, than the ideal or expected number $S_2$, which represents the successful guidance to the slit 2C. Thus, if the actually detected number of pulses does not correspond to the ideal or expected number of pulses under a permissible error range, the stringing operation is judged to fail and the pulse counter is reset (in step 11) and the sequence is fed back to the step 1. The instant embodiment is supposed to repeat three retrials. If the detected number of pulses should be different from the expected number of pulses at the third retry, the error indicator 701 is activated to warn the operator of the malfunction.

If the stringing operation is concluded to be successful in step 10, step 12 rotates the wiper 130 by approximately 180°, as shown in FIG. 16, from the initial position shown in FIG. 12 (see also FIG. 19A). Then, the lower thread 150 from the slit 2C is hooked by the wiper 130; the rest of the lower thread 150 is led to the tension spring top 2DD through the slit 2C, the tension spring 2D, and the guide hole 2G. Thereafter, the wiper 130 is reset to the initial position. Simultaneously, the bobbin drive motor M2 is driven to remove slacks of the thread 150 (see FIG. 19B).

This automatic threading operation is followed by the cutting operation.

First, the tension adjuster 204 is switched on, maximizing the solenoid thrust while minimizing the lower-thread tension. Then, step 13 rotates the working tool 116 clockwise from the position $I_0$ in FIG. 17 to position $I_8$. In step 14, the rotary arm 70 advances in the axial direction so that the working tool 116 may move the position $I_8$ to position $I_9$ in FIG. 17. Thus, the working tool 116 retreats from the opening end 2E. When the working tool 116 comes to the position $I_9$, one side edge of the cutout 116C closer to the opening end 2E overlaps extension A (which is orthogonal to the bobbin shaft 7*a*) of a center line of tension spring hole 2H into which the tension spring top 2DD is inserted.

Figure 17:
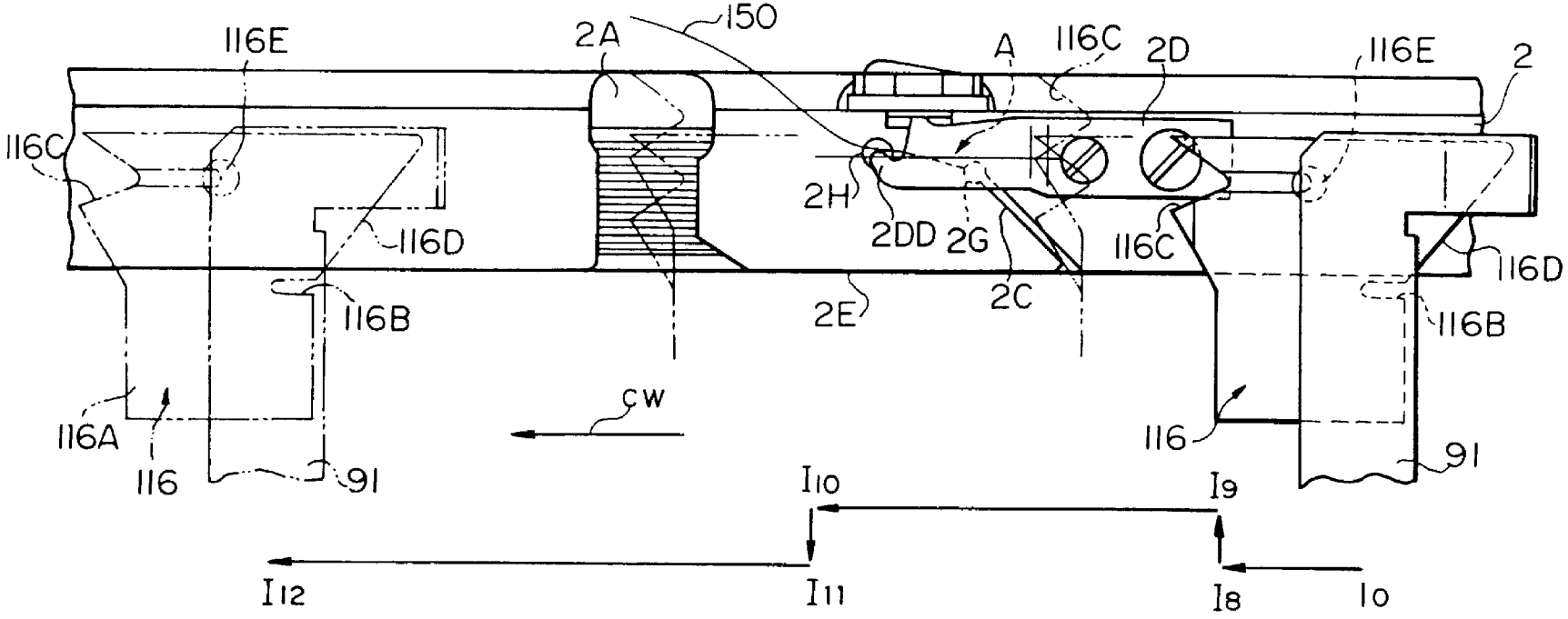
FIG. 17 is an exploded view for explaining how the working tool shown in FIG. 9 and a fixed cutter cut the lower thread after the stringing operation.

In step 15, the working tool 116 is further rotated clockwise from the position $I_9$ to position $I^{10}$ in FIG. 17. As a result, the cutout 116C catches the lower thread 150 if the thread 150 has projected from the guide hole 2G under the spring 2D and extended from a regular position under the spring top 2DD above the extension A in FIG. 17.

When the working tool 116 reaches the position $I_{10}$, step 16 retreats the rotary arm 70 in the axial direction so that the working tool 116 may move from the position $I_{10}$ to position $I_{11}$ in FIG. 17. Thus, the working tool 116 approaches the opening end 2E as the rotary arm 70 moves. The position $I_{11}$ corresponds to the positions $I_0$ and $I_8$ in the bobbin-shaft 7*a* direction, and is aligned to an extension of a cutting point between the fixed cutter 91 and the mobile cutter 116E in the circumferential direction of the bobbin shaft case 2. The fixed cutter 91 is fixed on the base plate 3. In step 17, the working tool 116 is further rotated clockwise from the position $I_{11}$ to position $I_{12}$ (i.e., the position $I_0$) in FIG. 17 (see also FIG. 18F). The lower thread 150 is cut between the mobile cutter 116E and the fixed cutter 91 during this movement, thereby setting the length of the lower thread between the spring top 2DD and the cutting point to be a necessary length for entwinement with the upper thread, such as around 40 mm.

Figure 19D:
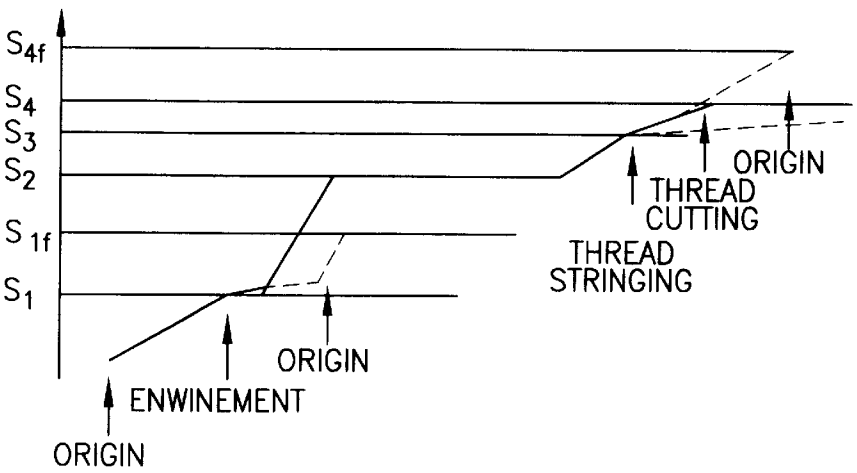

Hereupon, as the working tool 116 is rotated, the successfully strung lower thread 150 caught by the cutout 116C applies tension to the spool 200. Therefore, the spool 200 is induced to supply thread and this is detected. However, after the cutting operation, even when the working tool 116 is rotated, the tension is not applied to the spool 200 and the thread supply is not detected. Thus, the successfully strung lower thread 150 shows the number of pulses $S_4$ as shown in FIG. 19D when the thread is cut off. On the other hand, if the lower thread 150 should extend below the extension A in FIG. 17, namely if the stringing operation should fail, the lower thread 150 would be caught by flat surface 116F in FIG. 17 and transferred without getting cut as the working tool 116 moves to the position $I_{10}$. In this case, the number of pulses becomes $S_{4f}$ as shown in FIG. 19D.

If the stringing operation should fail and the lower thread 150 should not be caught at all by the working tool 116, the lower thread supply is not detected and the number of pulses becomes $S_3$ as shown in FIG. 19D.

If step 18 should conclude that the detected number of pulses is different from the ideal or expected number of pulses as a result of comparing them with each other under the permissible error range, step 19 would rotate the working tool 116 in the reverse direction and reset it to the initial position $I_0$. Then, step 20 removes the slacks in the same manner as described above, step 21 resets the pulse counter to $S_2$, and the sequence is returned to the step 12 to retry the steps. The instant embodiment is supposed to conduct three retrials. If the detected number of pulses should be different from the expected number of pulses at the third retry, the error indicator 701 is activated to warn the operator of the malfunction.

When the automatic cutting operation is completed, the rotary arm 70 is retreated and rotated so as to make the bobbin-case grip unit which does not house any bobbin case standby while at the same time causing the bobbin-case grip unit to oppose the shuttle 1. When the next bobbin exchange command is issued, the series of the above procedures are reiterated.

Thus, the instant invention improves the reliability of the stringing operation by: guiding the lower thread 150 from the opening 2A to the slit 2C through the aperture 2k by the working tool 116; removing slacks of the lower thread 150 by rotating the bobbin drive motor M2; adding tension to the spool 200 to induce it to supply the lower thread 150; detecting the amount of the lower thread supplied by the photo sensor 60 (including a pulse counter); and evaluating the stringing condition by the stringing evaluation unit 700 so as to correct a bad stringing condition.

When the stringing evaluation unit 700 judges it to be a bad condition, the working tool 116 is designed to automatically guide the lower thread 150 to the slit 2C again, thereby improving automation.

The instant embodiment also improves the reliability of the stringing operation by the combination of: holding by the working tool 116 only the lower thread which has projected from the lower-thread guide hole 2G and located more external than the regular position under the spring top 2DD; cutting the caught thread by the working tool 116 and the fixed cutter 91; detecting the amount of the lower thread supplied from the spool 200 by the photo sensor 60 (including a pulse counter); and checking the stringing condition by the stringing evaluation unit 700 so as to correct the bad stringing conditions.

When the stringing evaluation unit 700 judges it to be a bad condition, the working tool 116 automatically guides the lower thread 150 to the guide hole 2G again, thereby improving automation.

Moreover, the instant embodiment improves the reliability of the stringing operation by: catching and moving the successfully strung lower thread 150; cutting the lower thread 150 by the mobile cutter 116E and the fixed cutter 91; detecting the amount of lower-thread supplied by the photo sensor 60 (including the pulse counter); evaluating the stringing conditions based upon the detected result from the photo sensor 60 by the stringing evaluation unit 700; and retrying the procedures or warning the operator in response to the judgement of the stringing evaluation unit 700. This automatic retrial also improves automation.

The instant embodiment improves the reliability of the stringing operation by: catching the lower thread 150 extending from the opening 2A; and guiding the lower thread 150 to the tension spring top 2DD through the guide hole 2G, the slit 2C, and the aperture 2K by the working tool 116, while the rotary arm 70 is transferred in a direction parallel to the bobbin-shaft direction during the lower-thread guidance period to secure the successful stringing operation.

When the working tool 116 catches the lower thread 150 extending from the slit 2A, the rotary arm 70 retreats so that the working tool 116 may approach the opening end 2E. Thereby, the lower thread 150 is guided to the aperture 2k without getting hooked by the edge 2J. Such an arrangement will enhance the reliability.

The instant embodiment also results in cost saving by eliminating a conventionally required additional device, such as a stringing lever. Instead, the rotary arm 70 advances so that the working tool 116 may retreat from the opening end 2E when the lower thread 150 caught by the working tool 116 is guided to the slit 2C.

Furthermore, the instant embodiment improves the reliability of the stringing operation by: connecting the bobbin drive motor M2 to the bobbin 7 by the clutch 50; rewinding the bobbin 7 with the lower thread 150 by rotating the bobbin 7 with the bobbin drive motor M2; and disconnecting the bobbin drive motor M2 from the bobbin 7 by the clutch 50, when the lower thread 150 extending from the opening 2A is led to the slit 2C through the aperture 2k. As a consequence, the instant embodiment eliminates load from being applied to the bobbin 7 and maintains the smooth rotation of the bobbin 7, whereby the lower thread 150 is led to the slit 2C.

When the lower thread 150 is guided to the slit 2C, the clutch 50 connects the bobbin drive motor M2 to the bobbin 7 to rotate the bobbin 7 for a predetermined period in the same direction as the lower-thread winding direction, whereby slacks of the lower thread 150 are eliminated. Such an arrangement will enhance the above reliability.

While there have been shown and described and pointed out fundamental novel features of the invention as applied to currently preferred embodiments thereof, it will be understood that various omissions and substitutions and changes in the form and details of the devices illustrated, and in their operations, may be made by those skilled in the art without departing from the spirit of the invention. It is the invention, therefore, to be limited only as indicated by the scope of the claims appended thereto.

For example, contrary to the instant embodiment which fixes the working tool 116 and moves the bobbin case 2 in the bobbin-shaft direction for each of movements between the positions $I_1$–$I_2$, $I_3$–$I_4$, $I_5$–$I_6$, $I_{7'}$,–$I_{3'}$, $I_8$–$I_9$, and $I_{10}$–$I_{11}$, the working tool 116 may be moved whereas the bobbin case 2 is fixed. Since it is not necessary to move the clutch 50*a* in such a configuration, the connection between the bobbin drive motor M2 and the bobbin 7 by the clutch 50*a* may be conducted simultaneous or subsequent to the time that lower thread 150 is guided to the slit 2C.

The instant embodiment succeeded in miniaturizing the working tool 116 at the slope 116D and the cutout 116C by making the bobbin case 2 movable in the bobbin-shaft direction.

Figure 20:
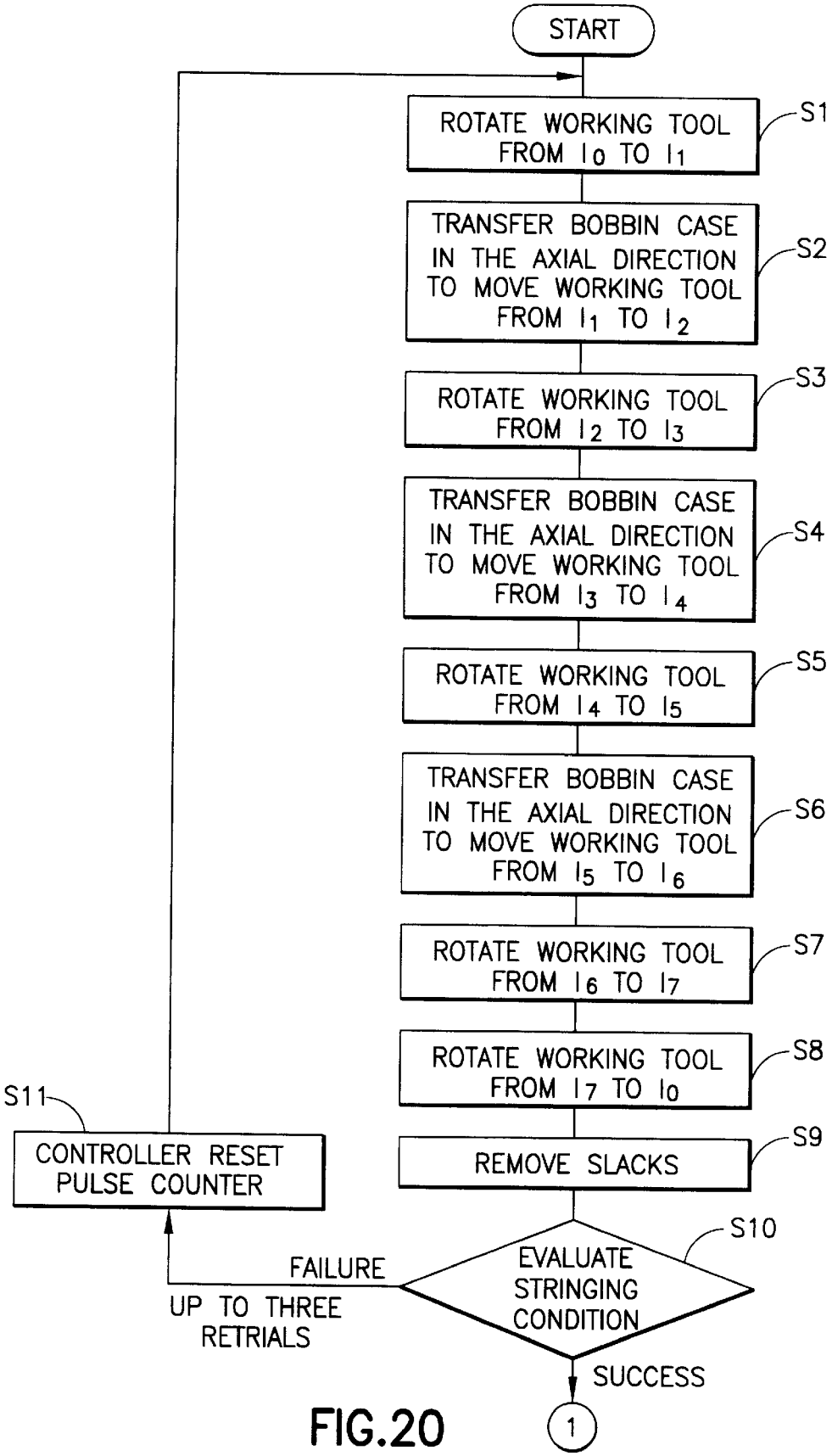
FIGS. 20 and 21 are flowcharts for the thread stringing operation and the thread cutting operation.
Figure 21:
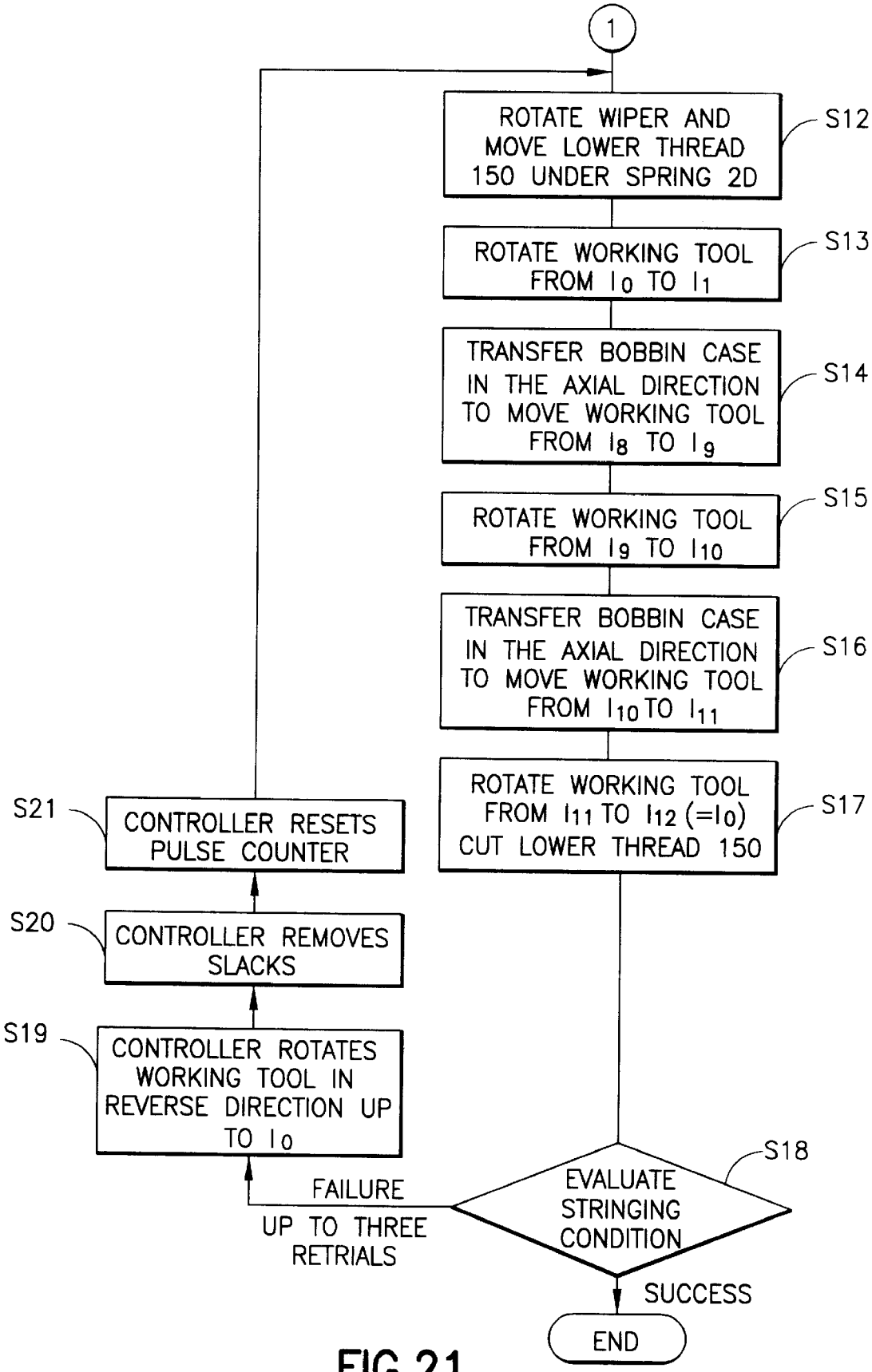

Also, the stringing condition may be evaluated only at the step 18, omitting the step 10 in FIGS. 20 and 21. In such a case, when the step 18 finds a bad stringing condition, the step sequence may be returned to the step 1 as a retry operation. Such an arrangement will of course contribute to the automation effectively.

What is claimed is:

1. A lower-thread winder comprising:

a thread winding unit which winds lower thread supplied from a lower-thread supply source around a bobbin which has been loaded into a bobbin case;

a thread guide which includes a stringer for catching the lower thread wound around the bobbin, wherein the thread guide strings the bobbin case with the lower thread caught by the stringer by moving the bobbin case and the stringer relative to each other;

a rotary unit which rotates the bobbin so as to remove slacks of the lower thread between the bobbin and the lower-thread supply source;

a detector which checks a condition of the lower thread between the bobbin and the lower-thread supply source while the bobbin is being rotated by said rotary unit; and an evaluation unit which evaluates a condition of stringing of the bobbin case based upon a detection result by said detector.

2. A lower-thread winder according to claim 1, wherein said bobbin case has an opening through which the lower thread is wound around the bobbin, a guide hole from which the lower thread is to extend, and a slit which connects the opening to the guide hole, and wherein said rotary unit rotates the bobbin when the slit is strung with the lower thread, and said evaluation unit evaluates a condition of stringing to the slit based upon a detection result by said detector.

3. A lower-thread winder according to claim 1, wherein said detector checks the condition of the lower thread by detecting an amount of the lower thread supplied from the lower-thread supply source.

4. A lower-thread winder according to claim 1, further comprising a controller which prompts said thread guide to retry the relative movement automatically when said detector detects a bad stringing condition.

5. A lower-thread winder according to claim 1, wherein said rotary unit rotates the bobbin intermittently for a predetermined period.

6. A lower-thread winder comprising:

a thread winding unit which wind s lower thread supplied from a lower-thread supply source around a bobbin loaded in a bobbin case;

a thread guide which strings the bobbin case with the lower thread;

grasp means for catching and extending the lower thread by a predetermined distance after said thread guide strings the bobbin case;

a detector which checks a condition of the lower thread between the bobbin and the lower-thread supply source when the lower thread is supposed to be caught by said grasp means; and an evaluation unit which evaluates a condition of stringing of the bobbin case based upon a detection result from said detector.

7. A lower-thread winder according to claim 6, further comprising cutter means for cutting the lower thread when said grasp means extends the lower thread by the predetermined distance.

8. A lower-thread winder according to claim 6, further comprising a controller which prompts said thread guide to retry the stringing of the bobbin case automatically when said detector detects a bad stringing condition.

9. A lower-thread winder utilizing a bobbin case having an opening for passing a lower thread wound around a bobbin in said bobbin case, and having a slit for guiding said lower thread from said opening to a guide hole being used to form a seam, comprising:

a thread winding unit which winds said lower thread around said bobbin by rotating said bobbin;

a thread guide having a stringer for catching the lower thread wound around said bobbin, wherein the thread guide guides said lower thread from said opening to said guide hole through said slit by moving the bobbin case and the stringer relative to each other;

a clutch being arranged to connect and disconnect between said thread winding unit and said bobbin loaded into said bobbin case; and a control device for connecting and disconnecting said clutch to not rotate said bobbin while said thread guide guides said lower thread from said opening to said slit.

10. A lower-thread winder comprising:

a thread winding unit which winds lower thread around a bobbin loaded into a bobbin case, said bobbin case having an opening through which the lower thread is wound around the bobbin, a guide hole from which the lower thread is to extend, and a slit which connects the opening to the guide hole;

stringing means for catch ing the lower thread wound around the bobbin and for guiding the lower thread from the opening to the guide hole through the slit;

drive means for rotating the bobbin case and the stringing means relative to each other around a bobbin shaft; and transfer means for linearly moving the stringing means and the bobbin case relative to each other along the bobbin shaft; and control means for controlling the transfer means to keep the lower thread caught by the stringing means apart from the opening while the stringing means guides the lower thread from the opening to the slit.

* * * * *